US010443255B1

(12) United States Patent
Lee

(10) Patent No.: US 10,443,255 B1
(45) Date of Patent: Oct. 15, 2019

(54) MODULAR STORE SYSTEM

(71) Applicant: Pivot Capital, LLC, Canton, GA (US)

(72) Inventor: Richard Y. Lee, Canton, GA (US)

(73) Assignee: PIVOT CAPITAL, LLC, Canton, GA (US)

( * ) Notice: Subject to any disclaimer, the term of this patent is extended or adjusted under 35 U.S.C. 154(b) by 0 days.

(21) Appl. No.: 15/965,394

(22) Filed: Apr. 27, 2018

Related U.S. Application Data

(60) Provisional application No. 62/490,749, filed on Apr. 27, 2017.

(51) Int. Cl.

| | |
|---|---|
| ***E04H 1/12*** | (2006.01) |
| ***A47F 9/04*** | (2006.01) |
| ***E04H 1/00*** | (2006.01) |
| ***A47F 9/00*** | (2006.01) |
| ***A47F 7/14*** | (2006.01) |

(52) U.S. Cl.
CPC ..... *E04H 1/1222* (2013.01); *A47F 7/148* (2013.01); *A47F 9/005* (2013.01); *A47F 9/04* (2013.01); *E04H 1/005* (2013.01)

(58) Field of Classification Search
CPC ..... E04H 1/1222; E04H 1/005; A47F 7/148; A47F 9/04; A47F 9/005
See application file for complete search history.

(56) References Cited

U.S. PATENT DOCUMENTS

| | | | |
|---|---|---|---|
| 4,565,074 | A | 1/1986 | Morgan |
| 4,637,222 | A | 1/1987 | Fujiwara et al. |
| 4,651,538 | A | 3/1987 | Bull et al. |
| 4,704,827 | A | 11/1987 | Murphy et al. |
| 5,048,233 | A | 9/1991 | Gidseg et al. |
| 5,226,556 | A | 7/1993 | Lu |
| 5,329,787 | A | 7/1994 | Friday |
| 5,350,086 | A | 9/1994 | Martin et al. |
| 5,545,841 | A | 8/1996 | Wilfinger et al. |
| 5,568,735 | A | 10/1996 | Newkirk et al. |
| 5,778,606 | A | 7/1998 | Davis, Jr. et al. |
| 5,845,515 | A | 12/1998 | Nelson |

(Continued)

FOREIGN PATENT DOCUMENTS

| | | | |
|---|---|---|---|
| CA | 2305007 | A1 | 10/2001 |
| DE | 4029872 | A1 | 3/1993 |

(Continued)

OTHER PUBLICATIONS

International Search Report dated May 15, 2015 for International Patent Application No. PCT/IB2015/050183, (13 pages).

*Primary Examiner* — Mark J Beauchaine
(74) *Attorney, Agent, or Firm* — Morris, Manning & Martin, LLP; Bryan D. Stewart; Daniel T. Begasse

(57) ABSTRACT

Systems and methods for a modular store system are disclosed. In particular embodiments, each modular store system includes one or more pre-fabricated, metal, interconnected, modular, units. Each of the units includes a baseplate, one or more chassis (possibly with one or more utility access holes), and subdeck. Each unit may also include other components, such as casters, level glides, a detachable veneer, pre-installed utilities, kick-plates, etc. As will be understood from discussions herein, pre-fabricated, metal (modular) units may reduce or eliminate the time-frame and associated costs of typical on-site (wooden) casework construction.

20 Claims, 31 Drawing Sheets

(56) References Cited

U.S. PATENT DOCUMENTS

| | | | | |
|---|---|---|---|---|
| 6,105,825 | A | 8/2000 | Gomi et al. | |
| 6,244,458 | B1 | 6/2001 | Frysinger et al. | |
| 6,349,559 | B1 | 2/2002 | Hasanovic | |
| 6,463,753 | B1 | 10/2002 | Haskayne | |
| 6,626,006 | B1 | 9/2003 | Tedder | |
| 6,698,229 | B2 | 3/2004 | Renken et al. | |
| 7,237,390 | B1 | 7/2007 | Nelson | |
| 8,065,889 | B1 | 11/2011 | Silberman | |
| 8,857,209 | B2 | 10/2014 | Wang | |
| 8,881,949 | B2 | 11/2014 | Schroeder et al. | |
| 9,334,649 | B2 | 5/2016 | O'Connor et al. | |
| 9,476,638 | B1 | 10/2016 | Tyler | |
| 9,909,797 | B2 | 3/2018 | Van Wuffen | |
| 2003/0183456 | A1 | 10/2003 | Hatzor | |
| 2004/0093892 | A1 | 5/2004 | Abfalter | |
| 2004/0256278 | A1 | 12/2004 | Kett et al. | |
| 2004/0265458 | A1 | 12/2004 | Christopher | |
| 2006/0021376 | A1 | 2/2006 | Scroggs | |
| 2006/0202594 | A1 | 9/2006 | Demars | |
| 2007/0137245 | A1 | 6/2007 | Ward | |
| 2008/0067900 | A1* | 3/2008 | Marshall ..... | A47B 87/008 312/108 |
| 2010/0200599 | A1 | 8/2010 | Molthen et al. | |
| 2011/0056232 | A1 | 3/2011 | Reese | |
| 2011/0094167 | A1 | 4/2011 | Noiseux et al. | |
| 2012/0104923 | A1 | 5/2012 | Jung et al. | |
| 2013/0033222 | A1 | 2/2013 | Hixson et al. | |
| 2014/0083024 | A1 | 3/2014 | Koppelman et al. | |
| 2014/0173998 | A1 | 6/2014 | Schoellkopf | |
| 2014/0300087 | A1 | 10/2014 | Bell | |
| 2015/0132082 | A1 | 5/2015 | Goshi et al. | |
| 2015/0232266 | A1 | 8/2015 | Ahmed et al. | |
| 2016/0025400 | A1 | 1/2016 | Van Wuffen | |
| 2016/0091239 | A1 | 3/2016 | Beland | |
| 2017/0010036 | A1 | 1/2017 | Lauchnor | |
| 2017/0115045 | A1 | 4/2017 | Aiken | |

FOREIGN PATENT DOCUMENTS

| | | | |
|---|---|---|---|
| DE | 20315208 | U1 | 2/2004 |
| DE | 202013105302 | U1 | 12/2013 |
| EP | 2499938 | A1 | 9/2012 |
| FR | 2227754 | A5 | 11/1974 |
| FR | 2531472 | A1 | 2/1984 |
| FR | 2576951 | A1 | 8/1986 |
| FR | 2589183 | A1 | 4/1987 |
| FR | 2626305 | A1 | 7/1989 |
| FR | 2727149 | A1 | 5/1996 |
| FR | 2760616 | A1 | 9/1998 |
| GB | 2528853 | A | 2/2016 |
| GR | 20080100153 | A | 1/2009 |
| HK | 1210241 | A1 | 4/2016 |
| IT | 1201913 | B | 2/1989 |
| KR | 20100110010 | A | 10/2010 |
| WO | 2002090241 | A1 | 11/2002 |
| WO | 2011017751 | A1 | 2/2011 |
| WO | 2013029135 | A1 | 3/2013 |
| WO | 2015068149 | A3 | 5/2015 |
| WO | 2016084042 | A1 | 6/2016 |

* cited by examiner

MODULAR STORE SYSTEM

CROSS REFERENCE TO RELATED APPLICATIONS

This application claims priority to, the benefit under 35 U.S.C. § 119 of, and incorporates by reference herein in its entirety U.S. Provisional Patent Application No. 62/490,749, filed Apr. 27, 2017, and entitled "MODULAR STORE SYSTEM."

TECHNICAL FIELD

The present systems and methods relate generally to casework solutions for commercial stores.

BACKGROUND

Commercial stores can take many forms: carts, kiosks, in-line stores or conventional stores. Stores in general may offer products, services, or a combination thereof. In some instances, stores are made up of casework, which is the aggregate assembly of parts that make up a box-shaped structure used for display, storage, or housing equipment. Casework can make up the entirety of a store (in the case of a cart or a kiosk) or specific interior components of a store (in the case of an in-line store or conventional store).

Carts are a mobile store offering a "point of sale" that may operate and be moved to different locations easily. Carts may be small in size and offer a limited selection of products or services and require limited utilities to operate. Carts are utilized, for example, at airports, malls, stadiums, concert venues, amusement parks, etc.

Kiosks are typically standalone stores that are free-standing and rely on its own structure. Kiosks can range from relatively small in size to medium sized stores. Kiosks can be erected in a relatively short timeframe compared to traditionally constructed stores. Once erected, kiosks may become permanent structures until taken down. Depending on the types of products and/or services provided, kiosks may be connected to various utilities (e.g., electric, water, sanitary). Kiosks may be utilized, of example, in airports, malls, stadiums, concert venues, amusement parks, etc.

In-line stores are generally individual stores that are part of a cluster of stores. In-line stores are common in retail malls, airports, outlet malls, convention centers, etc. Similar to an individual apartment within an apartment building, in-line stores typically share its outside walls and structure with the overall facility and adjacent stores.

Stores are typically "brick and mortar" establishments offering a variety of products and/or services. Stores can range from relatively small establishments to large box stores.

Traditionally, stores are constructed on-site using a multi-step and multi-trade build out, which may include foundation, framing, utility rough-in, drywall, trim, casework, countertops, finish utilities, fixtures, paint, etc. Each task is typically performed by different trades and delays in construction in any one of these components may prolong the construction of the store and increase costs in the construction of the same.

Casework for stores is typically constructed of plywood or other wood-based materials in such a manner that does not allow for dis-assembly of the individual parts as the wood materials may be stapled, glued or nailed together. In some instances, the store requires various utilities and/or an external heating/cooling system, which may need to be installed and running prior to the construction of the casework. Utility installation is typically performed after traditional, wood casework is constructed on-site.

Therefore, there is a long-felt but unresolved need for a flexible, durable, and pre-fabricated modular store system that can reduce or eliminate the timeframe and associated costs of typical on-site casework construction.

BRIEF SUMMARY OF THE DISCLOSURE

Briefly described, and according to one embodiment, aspects of the present disclosure generally relate to systems of casework construction. In particular embodiments, the systems and apparatuses here are completely pre-fabricated and include built-in equipment (e.g., sinks, faucets, ice bins, refrigerators, warmers, lighting, utilities, etc.). In at least one embodiment, the system include one or more units constructed of metal (steel, stainless steel, aluminum) that inter-connect to form a store system that resembles a traditional casework-based store design. In various embodiments, this store system may result in a complete store (cart or kiosk) or interior components to a store (in-line stores or stores). In at least one embodiment, each unit is free-standing and designed to be self-contained. Further, in at least one embodiment, each unit includes a number of standard (or semi-standard) components, including, but not limited to: a baseplate, one or more chassis, a subdeck, and various fasteners (or adhesives or the like) for connecting these components.

According to at least one embodiment, a modular store system includes a modular unit including: 1) a substantially rectangular metal baseplate including one or more legs, wherein the one or more legs are formed by bending a portion of the baseplate; 2) one or more metal intermediate chassis connected to the baseplate, wherein each of the one or more intermediate chassis are substantially perpendicular to the baseplate and include: a) at least one approximate 90 degree bend forming a first support arm substantially perpendicular to the baseplate; b) at least one approximate 90 degree bend forming a second support arm substantially parallel and connected to the baseplate; and c) at least one fastener hole; 3) a back chassis including at least one 90 degree bend forming a back support arm and defining a substantially keyhole-shaped opening, wherein the back chassis is connected to: a) at least one of the one or more intermediate chassis via the back support arm; b) a subdeck; and c) a veneer; 4) the subdeck including one or more access holes and one or more studs, wherein the subdeck is connected to the one or more intermediate chassis via the one or more studs; 5) a countertop including at least one anchor, the anchor fixed to the countertop via an adhesive and connected to the chassis through one of the one or more access holes in the subdeck; 6) a shock-absorbing adhesive between the subdeck and the countertop; and 7) a veneer detachably connected to the back chassis via the keyhole-shaped opening.

In one or more aspects, a modular store system includes a one or more modular units including: 1) a substantially rectangular metal baseplate including one or more legs, wherein the one or more legs are formed by bending a portion of the baseplate; 2) one or more metal intermediate chassis connected to the baseplate, wherein each of the one or more intermediate chassis: a) include at least one approximate 90 degree bend forming a support arm; b) include at least one fastener hole; and c) are substantially perpendicular to the baseplate; 3) a back chassis including at least one 90 degree bend forming a back support arm, wherein the back chassis is connected to each of the one or more intermediate chassis and a subdeck; 4) the subdeck including one or more access holes and one or more studs, wherein the subdeck is connected to the one or more intermediate chassis via the one or more studs; and 5) a countertop including at least one anchor, the anchor fixed to the countertop via an adhesive and connected to the chassis through one of the one or more access holes in the subdeck.

These and other aspects, features, and benefits of the claimed invention(s) will become apparent from the following detailed written description of the preferred embodiments and aspects taken in conjunction with the following drawings, although variations and modifications thereto may be effected without departing from the spirit and scope of the novel concepts of the disclosure.

BRIEF DESCRIPTION OF THE DRAWINGS

The accompanying drawings illustrate one or more embodiments and/or aspects of the disclosure and, together with the written description, serve to explain the principles of the disclosure. Wherever possible, the same reference numbers are used throughout the drawings to refer to the same or like elements of an embodiment, and wherein.

DETAILED DESCRIPTION

Figure 1A:
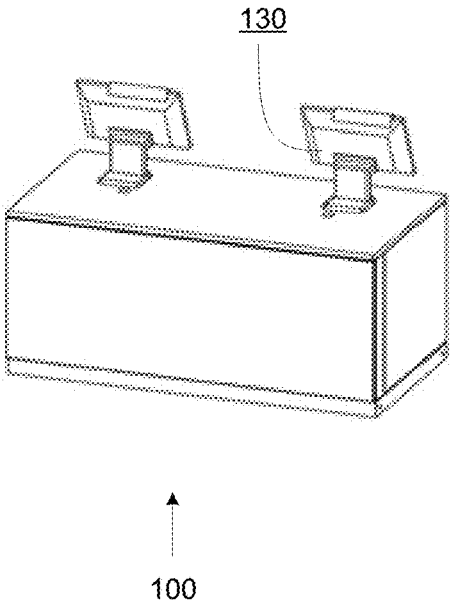
FIG. 1 (including FIGS. 1A-1B) shows perspective views of an exemplary modular store unit, according to one aspect of the present disclosure.

For the purpose of promoting an understanding of the principles of the present disclosure, reference will now be made to the embodiments illustrated in the drawings and specific language will be used to describe the same. It will, nevertheless, be understood that no limitation of the scope of the disclosure is thereby intended; any alterations and further modifications of the described or illustrated embodiments, and any further applications of the principles of the disclosure as illustrated therein are contemplated as would normally occur to one skilled in the art to which the disclosure relates. All limitations of scope should be determined in accordance with and as expressed in the claims.

Whether a term is capitalized is not considered definitive or limiting of the meaning of a term. As used in this document, a capitalized term shall have the same meaning as an uncapitalized term, unless the context of the usage specifically indicates that a more restrictive meaning for the capitalized term is intended. However, the capitalization or lack thereof within the remainder of this document is not intended to be necessarily limiting unless the context clearly indicates that such limitation is intended.

Overview

As discussed herein, the present systems and methods provide a new type of casework and construction for creating modular stores (e.g., kiosks, in-line stores, pop-up stores, etc.). In various embodiments, a modular store includes one or more units operatively connected such that utilities can run between each unit.

In particular embodiments, each unit includes a baseplate, one or more chassis, and a subdeck (of varying shapes/sizes). In some embodiments, a particular unit includes a kick-plate, one or more casters, a level glide, a veneer, a countertop, and/or various other components (e.g., a sink, a refrigerator, a point-of-sale system, etc.). As will be understood from discussions herein, each of the above components of a unit may be attached to one another via any suitable fastener, adhesive, or attachment mechanism (e.g., bolts, screws, by welding, via one or more clips, etc.).

In particular embodiments, each unit arrives at the construction site in one shipment and can typically be installed in less than one day. As will be understood, a modular store system may include various units arranged in fixed designs or may be engineered for flexibility, such that one or more units of the modular store may be rearranged in different configurations.

As mentioned above, in at least one embodiment, each unit includes a horizontal baseplate typically constructed out of metal. Each baseplate may connect various other components of the system and may be supported by level glides or wheels/casters sufficient to support the weight of the unit.

Further, according to particular embodiments, each unit includes one or more vertical chassis constructed out of metal affixed to a top surface of a baseplate to form interior walls of a particular unit. In some embodiments, the chassis are connected to each other to provide structure and support. In some embodiments, the chassis are designed to support and/or be connected to various other components, such as veneers, doors, shelves, and/or other interior components for a variety of functionality.

In one or more embodiments, each unit includes a horizontal subdeck constructed out of metal affixed to the top surface of the metal chassis. As will be understood from discussions herein, the combination of the baseplate, chassis, and subdeck may provide most of the structural integrity of a given unit. In particular embodiments, a subdeck is designed to receive and/or be connected to various components, such as countertops, sinks, ice bins, and draft equipment.

In at least one embodiment, a modular store system (e.g., one or more interconnected modular store units), has no floor penetrations as each unit is designed to be free-standing on adjustable level glides or wheels/casters affixed to the baseplate. Such a configuration provides the unique advantage of a fixed installation, but also offers the flexibility for one or more units to be moved or re-arranged.

As discussed above, a modular store system may include, in some embodiments, one or more veneers, fixtures, and/or signage used to provide aesthetic appeal or end design of the store. In various embodiments, the one or more veneers are affixed to the metal chassis using a keyhole system and are updateable and/or replaceable. As further discussed herein, the one or more veneers constructed from, but are not limited to, wood, tile, brick, leather, upholstery, glass, ice, and stone. Fixtures can include, but are not limited to, lighting, signage, menus, slat wall, and video boards.

Each unit may include pre-installed utilities. In some embodiments, units are designed to allow the passage of utilities between units through access holes in the chassis. Pre-installed utilities can include, but are not limited to, electric, water, sanitary, and low voltage.

Each unit may include a countertop installed on the subdeck. Countertop materials may include, but are not limited to, stainless steel, Corian®, quartz, granite, marble or other countertop material utilized in commercial stores.

A unit or a combination of units may include pre-installed under-counter equipment. Pre-installed equipment can include, but is not limited to, refrigeration, ice bins, ice machines, draft equipment, warming units, trash compartments, insulated storage, water filtration, and ambient displays.

As will be understood, a modular store as discussed herein may replace conventional casework for virtually any type of store. Possible applications include, but are not limited to, coffee cafes, bars, restaurants, customer service stands, retail product stores, and grab & go type stores.

The above components (and others), will be discussed below in relation to the figures.

Exemplary Unit

As discussed herein, according to various embodiments, a modular store system includes one or more units, where each of the one or more units includes a baseplate, one or more chassis, and a subdeck. Each of the one or more units may be operatively connected to another unit (or more than one unit), such that the one or more units form a partial or complete store (e.g., a kiosk, an in-line store, etc.). This disclosure discusses each of these components of a typical unit (baseplate, chassis, subdeck) along with additional components (kickplate, countertop, etc.), and different exemplary arrangements of units below.

Figure 1B:
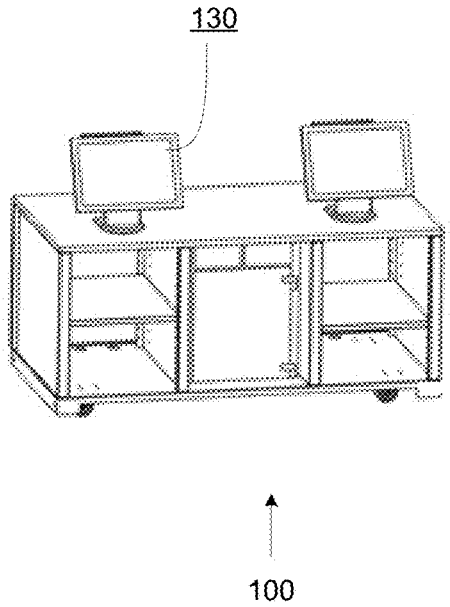

Referring now to the figures, for the purposes of example and explanation of the processes and components of the disclosed systems and methods, reference is made to FIG. 1, which includes FIGS. 1A-1B, according to one embodiment of the present disclosure. FIGS. 1A and 1B show an exemplary front view and back view of an exemplary unit 100 designed as a consumer transactional unit housing point of sale equipment 130. This exemplary unit includes a baseplate, one or more chassis, a subdeck, and various additional components, which will be further discussed in relation to FIG. 2.

Figure 2:
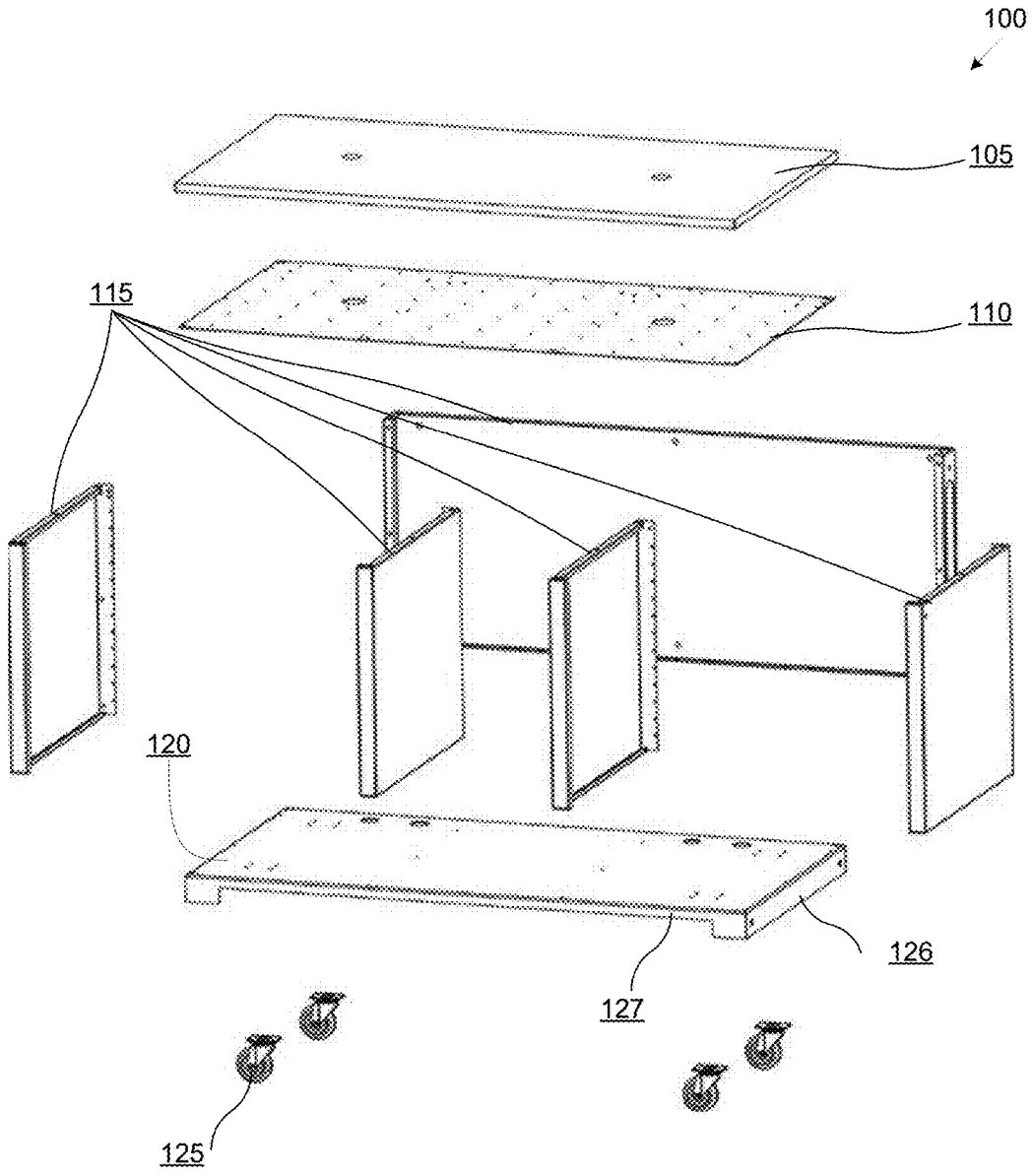
FIG. 2 shows an exploded view of the exemplary modular unit of FIG. 1, according to one aspect of the present disclosure.

FIG. 2 shows an exploded view of exemplary unit 100. In the embodiment shown in FIG. 2, the exemplary unit 100 includes one or more wheels 125, a baseplate 120, one or more chassis 115, a subdeck 110, and a countertop 105.

In the embodiment shown in FIG. 2, the baseplate 120 is substantially rectangular in shape, includes one or more feet 126 and includes one or more holes. As will be understood from discussions herein, in various embodiments, the baseplate 120 is made of metal and the one or more feet are formed by bending the metal of the baseplate 120. In the embodiment shown in FIG. 2, the one or more feet may be connected via metal flange 127 (e.g., an additional portion of bent metal) that runs between the one or more feet. In some embodiments, the metal flange extends downward from a top portion of the baseplate 120 to a distance substantially equal to the distance from the top portion of the baseplate 120 to the bottom of the one or more feet. In further embodiments, the metal flange extends downward from the top portion of the baseplate 120 to a distance less than the distance to the bottom of the one or more feet (e.g., 1 inches, 1.5 inches, 2 inches, etc.).

As will be understood from discussions herein, the baseplate 120 may be any suitable size/shape. In some embodiments, the baseplate 120 is approximately 48 inches wide by 144 inches long. In various embodiments, the baseplate 120 maybe between 36 inches wide by 60 inches long and 24 inches wide by 36 inches long, etc. In particular embodiments, the baseplate 120 may be less than 48 inches wide and 144 inches long.

Continuing with FIG. 2, in various embodiments, the baseplate 120 is connected to the one or more chassis 115 via a suitable fastener (e.g., bolts, screw, rivet, etc.). In some embodiments, the one or more chassis 115 include one or more bends (substantially at a 90 degree angle) substantially parallel to the baseplate 120 and the one or more chassis 115 are connected to the baseplate 120 via the one or more bends. In further embodiments, the one or more chassis 115 include at least one substantially 90 degree bend that may act as a support arm for the subdeck 110, countertop 105, and/or any additional items that may be placed on the countertop 105 (e.g., POS, refrigerator, etc.).

According to at least one embodiment, one of the one or more chassis 115 may act as a "back chassis" connecting the other chassis 115 and further supporting the subdeck 110, countertop 105, etc. As will be understood the back chassis may be connected to the one or more other chassis via a 90 degree bend/support arm.

The one or more chassis 115 may be any suitable size, including but not limited to approximately 24 inches long by 18 inches wide, 36 inches long by 24 inches wide, 96 inches long by 30 inches wide, 30 inches long by 30 inches wide, 112 inches long by 26 inches wide, etc.

As shown in the embodiment of FIG. 2, the subdeck 110 is substantially rectangular in shape and includes one or more holes (to remove weight from the subdeck 110 and/or allow for items, such as electrical wires, to pass through the subdeck 110). In some embodiments, the subdeck 110 includes one or more studs (not shown) for attaching the subdeck 110 to the one or more chassis 115 (via a bolt or the like). As will be understood from discussions herein, the subdeck 110 may be operatively (or removeably) attached to the one or more chassis 115 in any suitable way, including, but not limited to, by an adhesive, a fastener (e.g., screw, etc.), and/or by welding or the like.

In various embodiments, the subdeck 110 is attached to the countertop 105 using anchor chips and shock absorbing adhesive. In various embodiments, the anchor clips are attached to bottom surface of countertop 105 using an adhesive and the anchor clips are then bolted to (at least one of) the one or more chassis 115 through an access holes in the subdeck 110.

Although the components shown in FIG. 2 are generally discussed as being constructed from metal, these components may be constructed from and/or include various materials, including, but not limited to, wood, plywood, steel, stainless steel, and polyvinyl.

Figure 3:
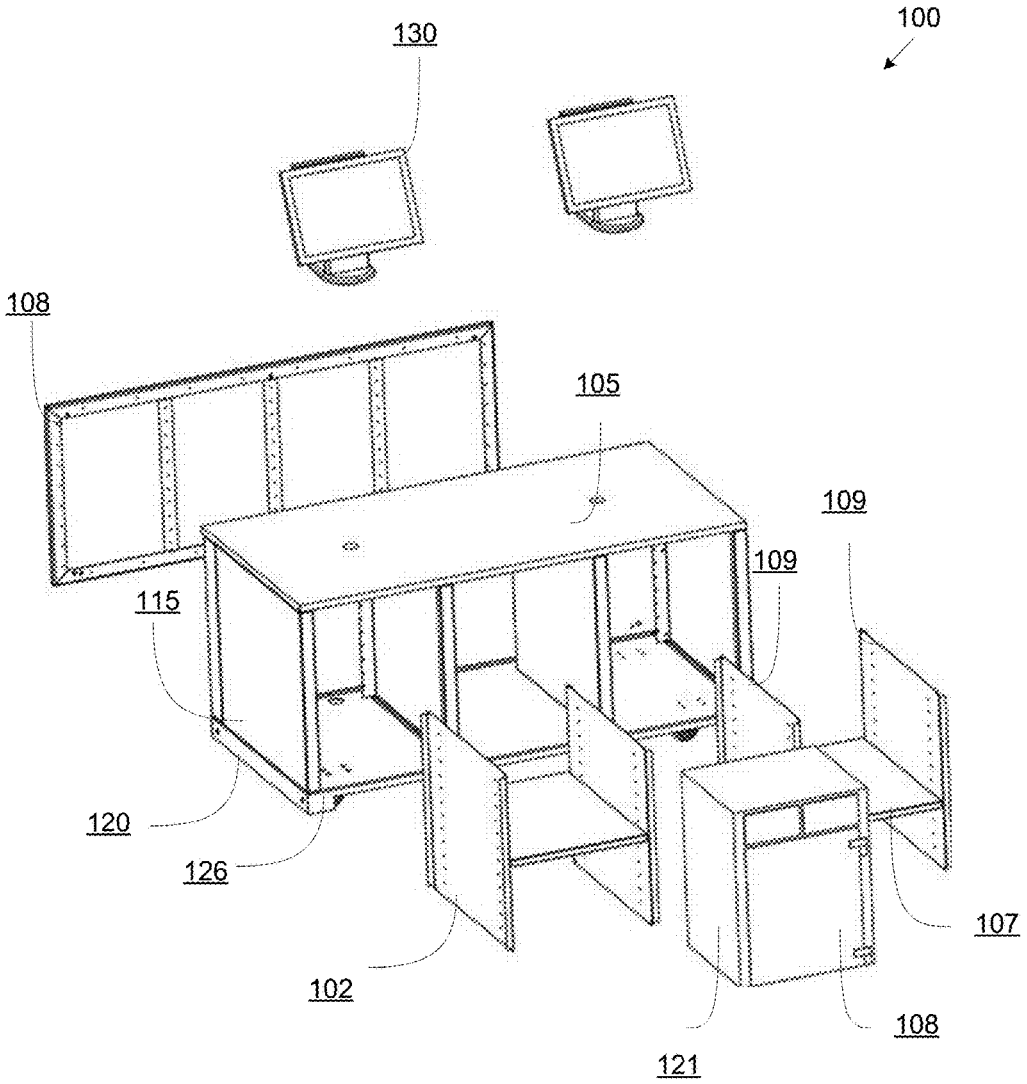
FIG. 3 shows an exploded view of an exemplary modular store unit, according to one aspect of the present disclosure.

Turning now to FIG. 3, a partially exploded view of the exemplary unit 100 is shown. In the embodiment shown in FIG. 3, the system includes a veneer 108, a shelf system 102, and a safe 121 (in addition to the components described in relation to FIGS. 1-2). In the embodiment shown in FIG. 3, the baseplate 120 is substantially rectangular in shape, includes one or more feet 126. In the embodiment shown in FIG. 3, the baseplate 120 is connected to the one or more chassis 115 via a suitable fastener (e.g., bolts, screw, rivet, etc.). In some embodiments, the one or more chassis 115 include one or more bends (substantially at a 90 degree angle) substantially parallel to the baseplate 120 and the one or more chassis 115 are connected to the baseplate 120 via the one or more bends. In further embodiments, the countertop 105, and/or any additional items that may be placed on the countertop 105 (e.g., POS 130, refrigerator, etc.).

In various embodiments the veneer 108 is detachably connected to the one or more chassis 115 utilizing a keyhole system that allows the veneer to be attached or removed. In at least one embodiment, the one or more chassis 115 defines one or more "keyhole" shaped openings that allows the veneer 108 to be hung from and/or locked onto the one or more chassis 115 via a suitable fastener or stud protruding from the veneer 108 (e.g., bolts, screw, rivet, etc.). As would be understood from the discussion herein, the veneer 108 may be constructed of any suitable material, including, but not limited to, wood, plywood, stone, tile upholstery, steel, stainless steel, metal, glass, brick, etc.

In various embodiments, the shelf system 102 comprises at least one shelf 107 and at least two vertical upright supports 109. In particular embodiments, the vertical upright supports 109 are include one or more mechanisms for supporting the at least one shelf 107. According to one or more embodiments, the at least one shelf 107 can be positioned at various vertical locations on either side of the vertical upright supports and is positioned perpendicular to the baseplate 120. In one example, assembly, the vertical upright supports 109 include holes (or a series of holes) for attaching the at least one shelf 107 via suitable fastener (e.g., bolts, screw rivet, etc.). Those skilled in the art will also recognize that shelves can be stacked in parallel at desired locations.

As discussed herein, the unit 100 may include various other items useful in a store. In the embodiment shown in FIG. 3, the unit 100 includes a safe 121 comprises a frame, a door panel 108 connected to frame by hinge mechanism and the point-of-sale (POS) equipment 130 (placed on the countertop 105).

Figure 4:
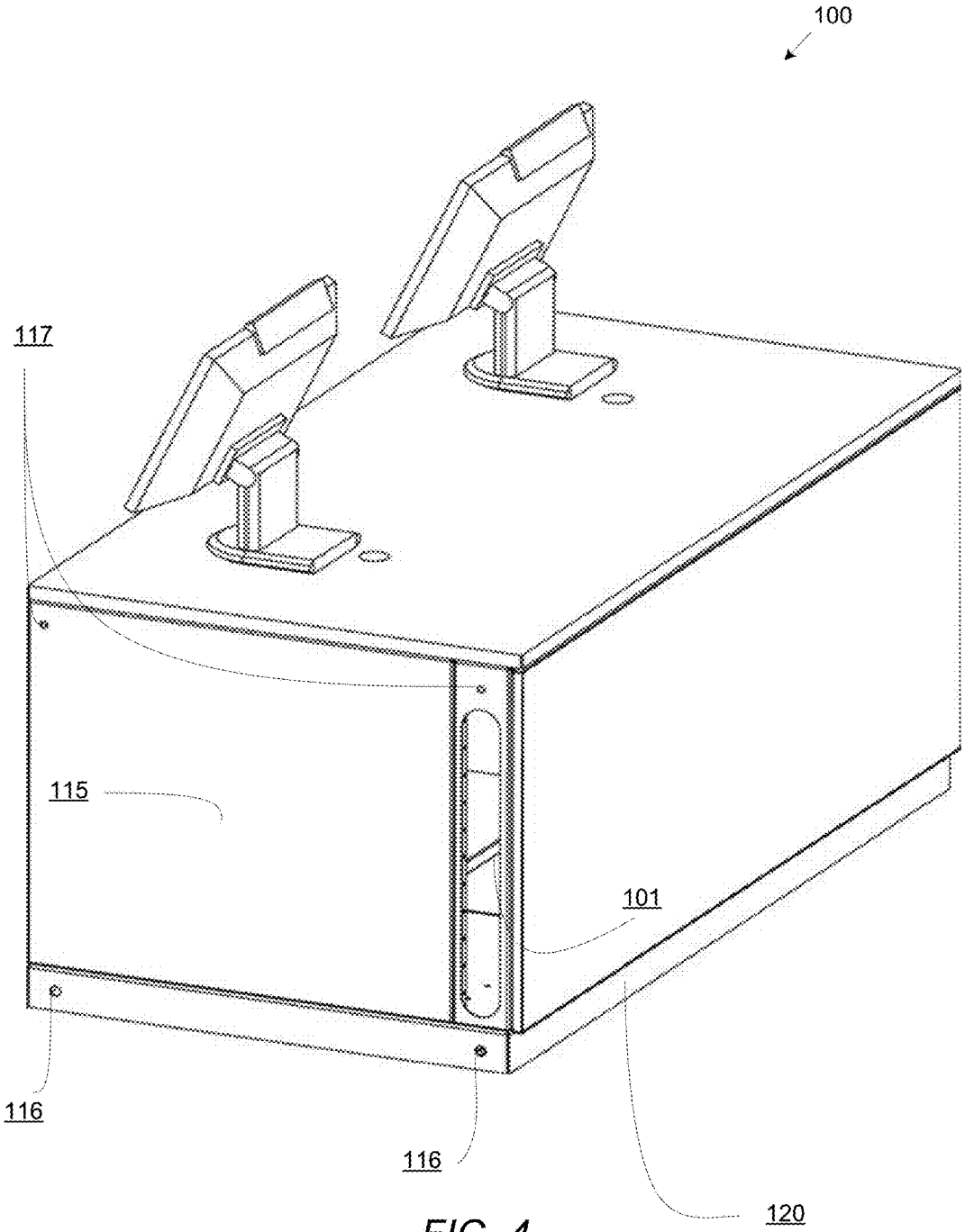
FIG. 4 shows a perspective view of an exemplary modular store unit, according to one aspect of the present disclosure.

FIG. 4 shows a perspective view of an exemplary modular store unit, according to one aspect of the present disclosure. In various embodiments, each unit has a minimum of two attachment points 116 on the baseplate 120 and two attachment points 117 on the one or more chassis 115. In some embodiments, bolts, screws, fasteners and locknuts are used for connecting one unit to another unit via the two attachment points 116 on the baseplate 120 and the two attachment points 117 on the one or more chassis 115. In the embodiment shown in FIG. 4, the baseplate 120 and the one or more chassis 115 each define the respective attachment points 116 and/or 117. In further embodiments, the unit 100 is operatively connected (e.g., detachably or permanently) to another unit by any suitable mechanism.

In various embodiments, the unit 100 includes a utility access hole 101 defined by the one or more chassis 115. In at least one embodiment, the one or more chassis 115 defines the utility access hole (opening) 101, which is substantially an extended oval shape. In some embodiments, the one or more chassis 115 may define any suitably-shaped utility access hole, such as, but not limited to, substantially circular, substantially rectangular, etc. According to particular embodiments, and as further discussed herein, the utility access hole 101 is used to communicate utilities between units (e.g., preinstalled utilities). These utilities include, but are not limited to, electric, water supply, sanitary and low voltage.

Figure 5A:
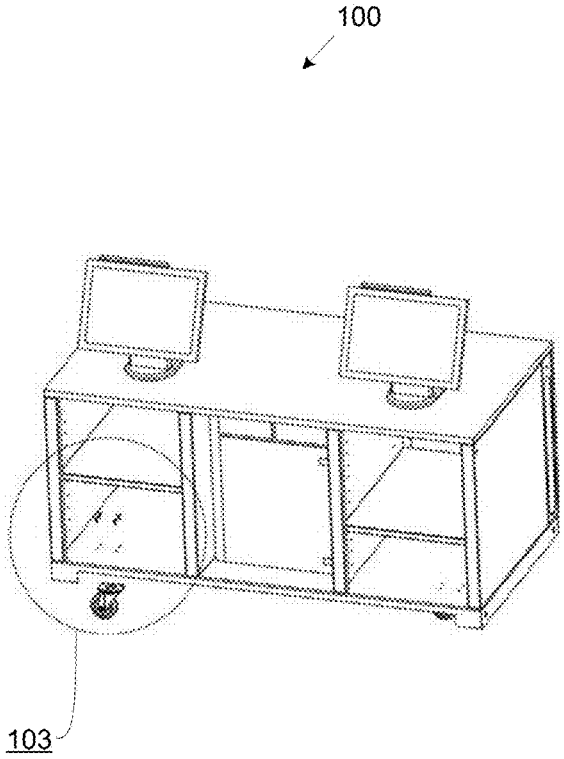
FIG. 5 (including FIGS. 5A-5B) shows a perspective view of an exemplary modular store unit, according to one embodiment of the present disclosure.
Figure 5B:
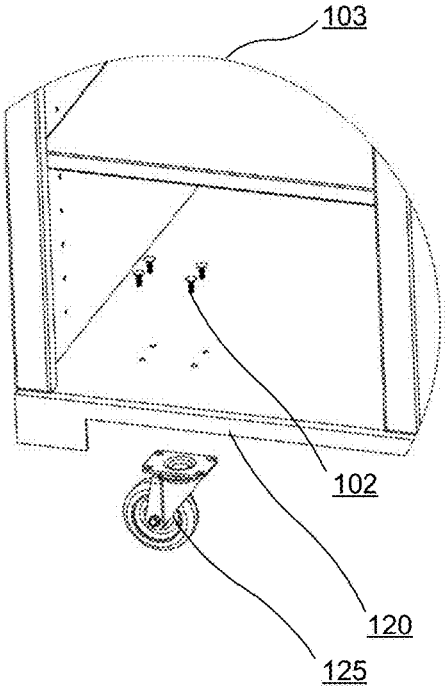

FIG. 5 (including FIGS. 5A-5B) shows a perspective view of an exemplary modular store unit, according to one embodiment of the present disclosure. FIGS. 5A-5B show a detailed view 103 of an exemplary connection point to a wheel or caster. In the embodiment shown in FIG. 5, the unit 100 includes a wheel or caster 125, which is secured to the bottom surface of the baseplate 120 with bolts 102. As will be understood from discussion herein, a caster maybe connected to the baseplate 120 by (but not limited to) bolts, screws, locknuts, fasteners, brackets and welding. As will also be understood, in various embodiments, the unit 100 may have between four and ten wheels or casters with some of the wheels or casters containing locks to prevent the unit from moving once locked in place.

Figure 6A:
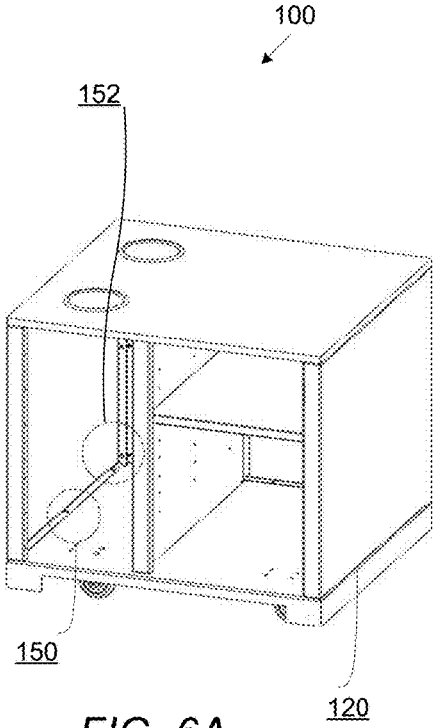
FIG. 6 (including FIGS. 6A-6C) shows a perspective view of an exemplary modular store unit, according to one embodiment of the present disclosure.
Figure 6C:
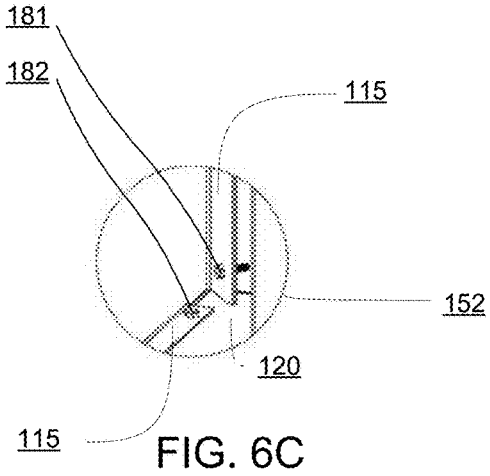
Figure 6B:
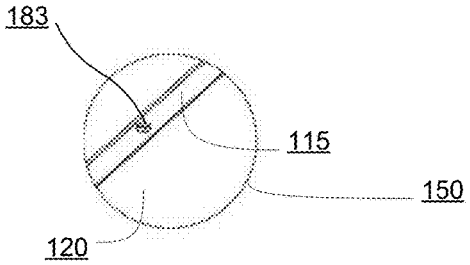

FIG. 6 (including FIGS. 6A-6C) shows a perspective view of an exemplary modular store unit, according to one embodiment of the present disclosure. FIGS. 6A-6C show a detailed view 152 of an exemplary connection of the one or more chassis 115 to baseplate 150 and chassis to each other. In the embodiment shown in FIG. 6, the one or more chassis 115 are attached to the top surface of the baseplate 120 with three to six bolts each at attachment points 182 and 183. As further discussed herein, each of the one or more chassis 115 includes one or more support arms formed from being the one or more chassis 115 (e.g., flanges formed at substantially 90 degrees) and each of these support arms can define holes for connecting the one or more chassis 115 to the baseplate 120 and/or other chassis.

In the embodiment shown in FIG. 6, the one or more chassis 115 are attached to each other by three to six bolts each at attachment point 181. In particular embodiments, using holes and bolts (or other removeable fasteners) may allow for the unit 100 to be assembled and dis-assembled if needed to allow for the replacement of damaged parts.

Figure 7A:
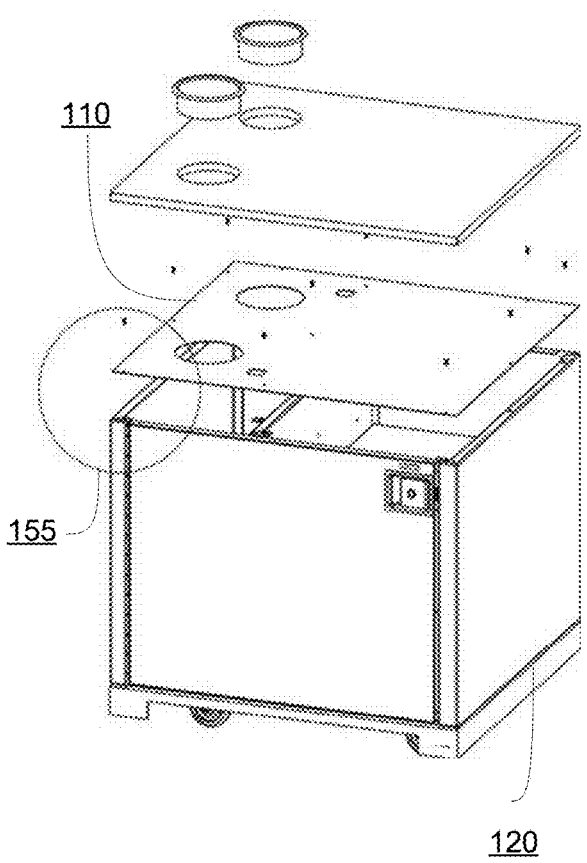
FIG. 7 (including FIGS. 7A-7B) shows a perspective view of an exemplary modular store unit, according to one embodiment of the present disclosure.
Figure 7B:
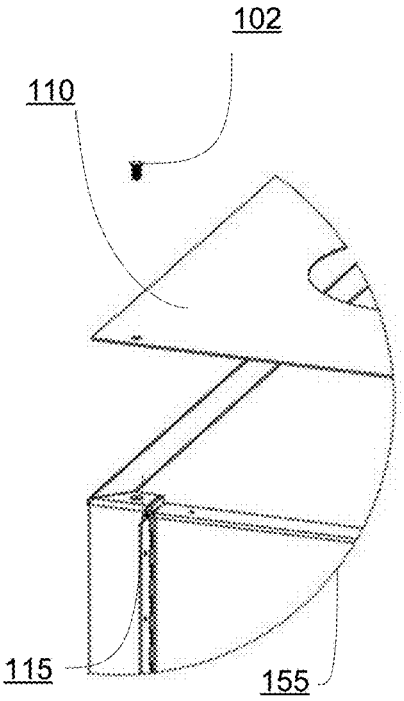

FIG. 7 (including FIGS. 7A-7B) shows a perspective view of an exemplary modular store unit, according to one embodiment of the present disclosure. The embodiment of FIG. 7 shows details of a subdeck 110 used as the top surface of the unit 100 in view 155. In various embodiments (and as further discussed herein), the subdeck 110 provides structural integrity for the unit 100. In particular embodiments, the subdeck 110 is attached to the unit 100 by press-fit or weld-on studs 102 that provide a flat surface on top of the subdeck 110. In some embodiments, the studs 102 are inserted into fastener holes located in the one or more chassis 115 and secured with nuts from inside the unit 100.

As will be understood from discussions herein, in at least one embodiment, the subdeck 110 provides support for service-type items (and enables attachment and removal of the same). In various embodiments, the service type items may include sinks, ice bins, countertops, draft equipment, etc.

Figure 8A:
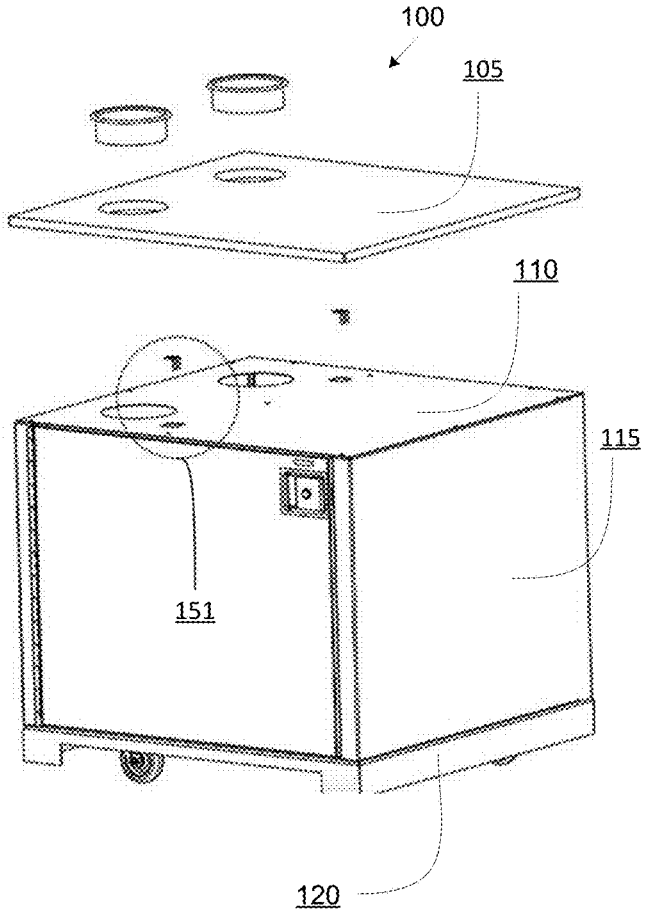
FIG. 8 (including FIGS. 8A-8B) shows a perspective view of an exemplary modular store unit, according to one embodiment of the present disclosure.
Figure 8B:
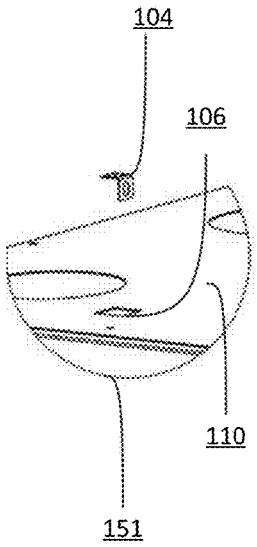

FIG. 8 (including FIGS. 8A-8B) shows a perspective view of an exemplary modular store unit, according to one embodiment of the present disclosure. In various embodiments, the unit 100 includes one or more anchor clips 104 as shown in the detailed view 151. The one or more anchor clips 104, in at least one embodiment, are attached to a bottom surface of the countertop 105 with an adhesive. The one or more anchor clips 104 pass through access holes (e.g., openings) 106 defined by subdeck 110 and are attached to the one or more chassis 115 via a bolt (or the like).

In at least one embodiment, the unit 100 includes a bed of shock absorbing adhesive (now shown) between the subdeck 110 and the countertop 105. The shock absorbing adhesive may include (but is not limited to) silicon or another suitable adhesive.

As will be understood from discussions herein, the countertop 105 is used to support various service items (e.g., a POS) and/or for a user to conduct various activities while working in a modular store system. In various embodiments, the countertops may be constructed of many different materials including, but not limited to, Corian®, quartz, marble, stainless steel, wood and granite.

Exemplary Modular Store System

Figure 9:
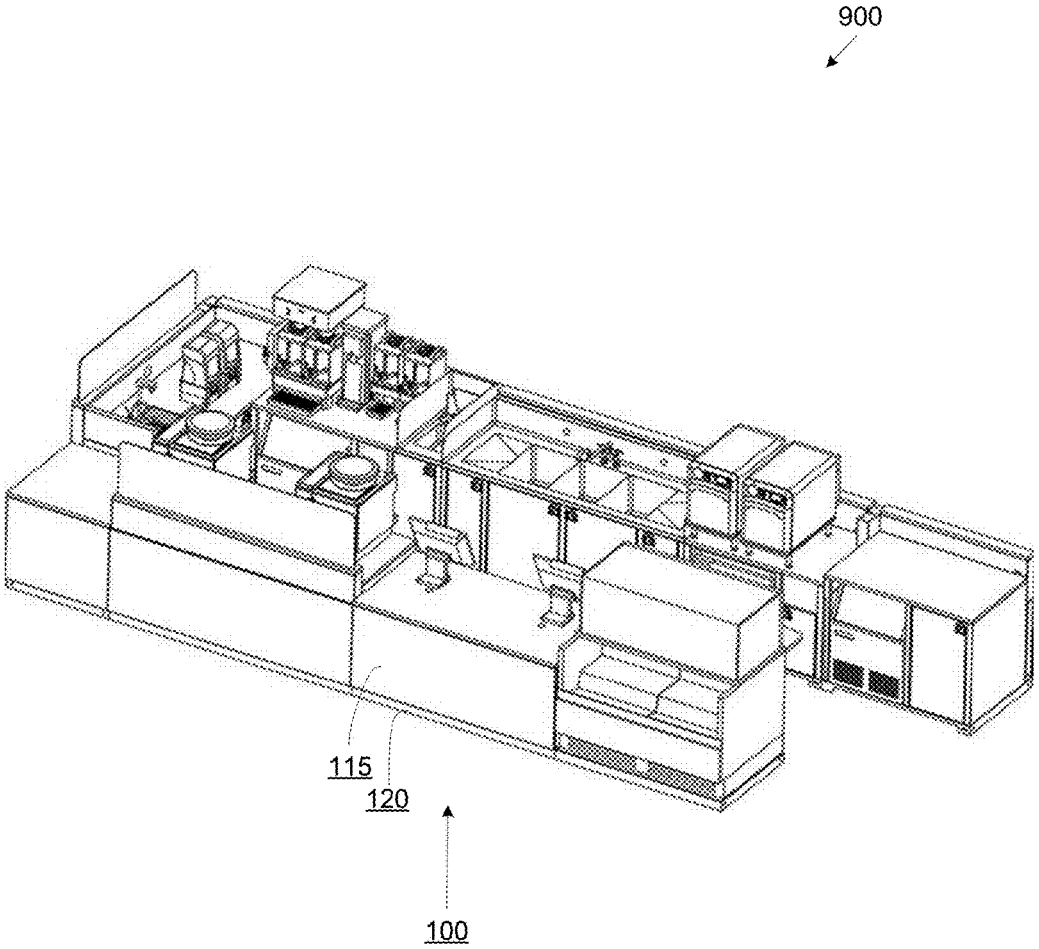
FIG. 9 shows a perspective view of exemplary modular store units included in an exemplary modular store that may replace typical casework in an in-line or traditional store.

FIG. 9 shows a perspective view of exemplary modular store units included in an exemplary modular store that may replace typical casework in an in-line or traditional store. The exemplary unit 100 discussed above and shown in FIGS. 1-8 may be included in the exemplary modular store system 900 shown in FIG. 9. As will be understood from discussions herein, each of the units shown in FIG. 9 may include one or more (or all) of the components discussed above in regards to exemplary unit 100.

FIG. 9 shows an exemplary modular store system 900 that includes nine units that may replace typical casework in an in-line or traditional store. In various embodiments, each unit (e.g., unit 100) is bolted onto an adjacent unit by a baseplate (e.g., baseplate 120) and one or more chassis (e.g., one or more chassis 115) to create the complete modular store system 900. In particular embodiments, a minimum of two bolts are used on each baseplate and two bolts on the connecting chassis. The modular store system 900 may include various utilities that connect through individual units via utility access holes (e.g., utility access hole 101 as shown in FIG. 4).

Figure 10:
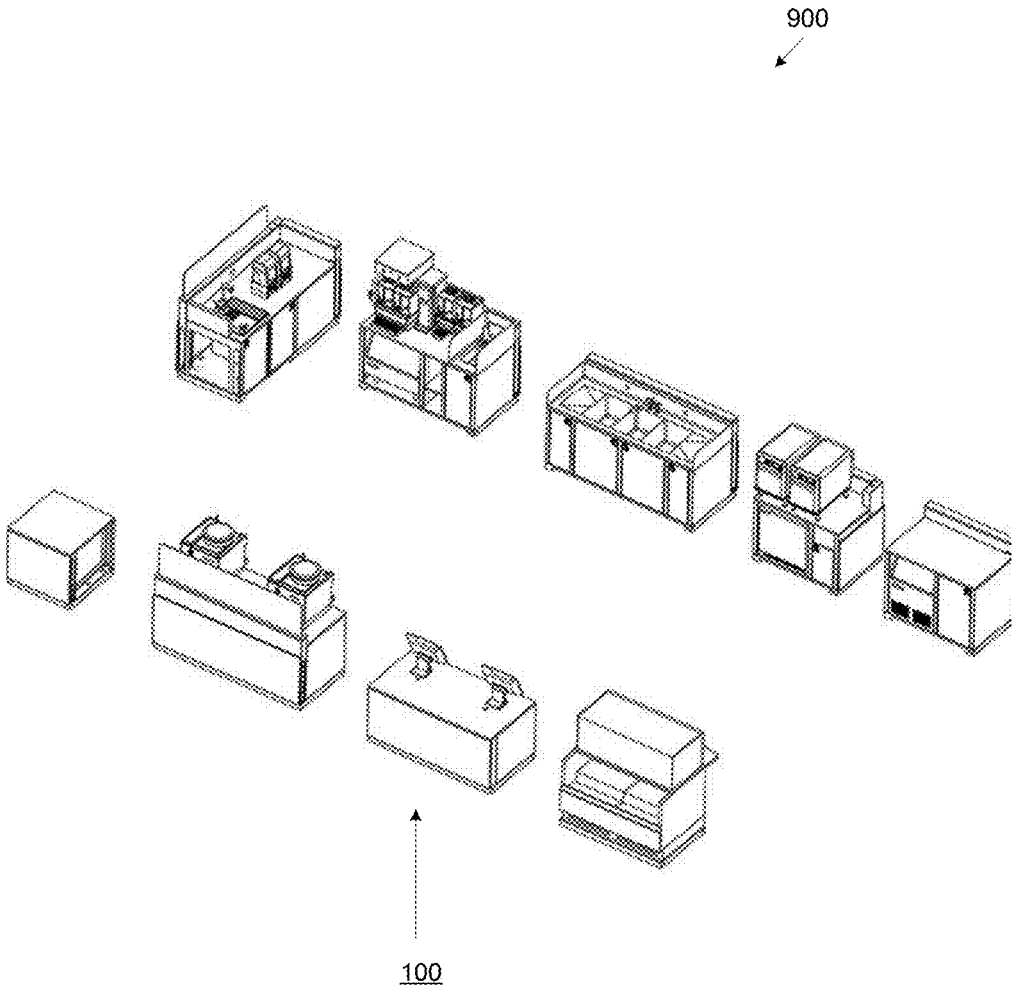
FIG. 10 shows an exploded view of the modular store system of FIG. 9 depicting each unit individually prior to being attached to its adjacent unit to form an exemplary modular store system.

FIG. 10 shows an exploded view of the modular store system of FIG. 9 depicting each unit individually prior to being attached to its adjacent unit to form an exemplary modular store system. As shown in FIG. 10, the modular store system 900 includes a variety of different units (e.g., unit 100) that are modular and can be arranged in a variety of suitable ways (e.g., depending on the needs of a vendor, user, etc.).

Additional Exemplary Units/Features

As discussed above, each modular store system may include a variety of different units (e.g., interconnected units). These additional exemplary units typically include the same structural features as exemplary unit 100 discussed above (e.g., baseplate, one or more chassis, and subdeck), but one or more of the units may be a different size, shape, etc. and may include a number of different components than exemplary unit 100. Examples of these additional exemplary units and some additional features applicable to any unit (including unit 100 discussed above) are discussed below in relation to FIGS. 11-18. For clarity and brevity, the baseplates, one or more chassis, subdecks, countertops, and their related components (e.g., fasteners, adhesives, etc.) of these additional exemplary units will not be discussed in detail below.

Figure 11A:
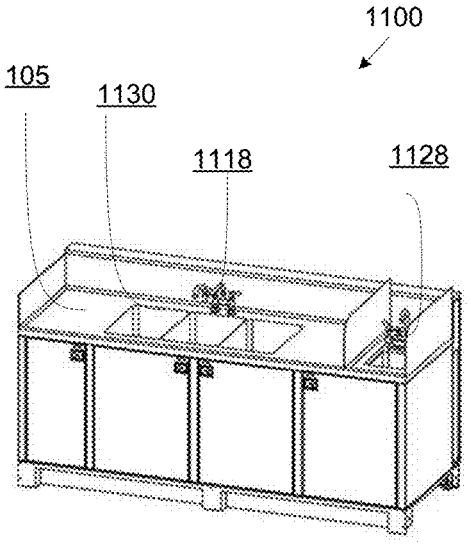
FIG. 11 (including FIGS. 11A-11B) shows a perspective view of an exemplary modular store unit, according to one embodiment of the present disclosure.
Figure 11B:
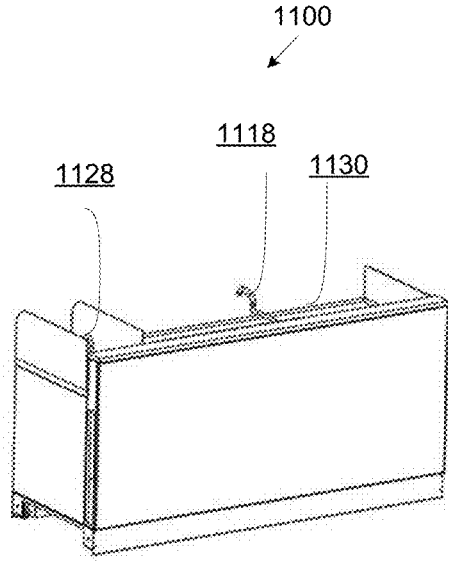

FIG. 11 (including FIGS. 11A-11B) shows a perspective view of an exemplary modular store unit, according to one embodiment of the present disclosure. As shown in FIG. 11, exemplary unit 1100 includes a countertop 105 that houses a three compartment sink 1130 and hand sink 1128. In various embodiments, the three compartment sink 1130 and hand sink 1128 each have a water faucet handle 1118 which operates as a conventional valve for supplying water at the various (or a set) temperature to the outlet of a water tap. In particular embodiments, the various sink compartments include an upright partition there between and relatively close to the water tap. The sinks 1130 and/or 1128 may also include walls or partitions between the sinks.

Figure 12:
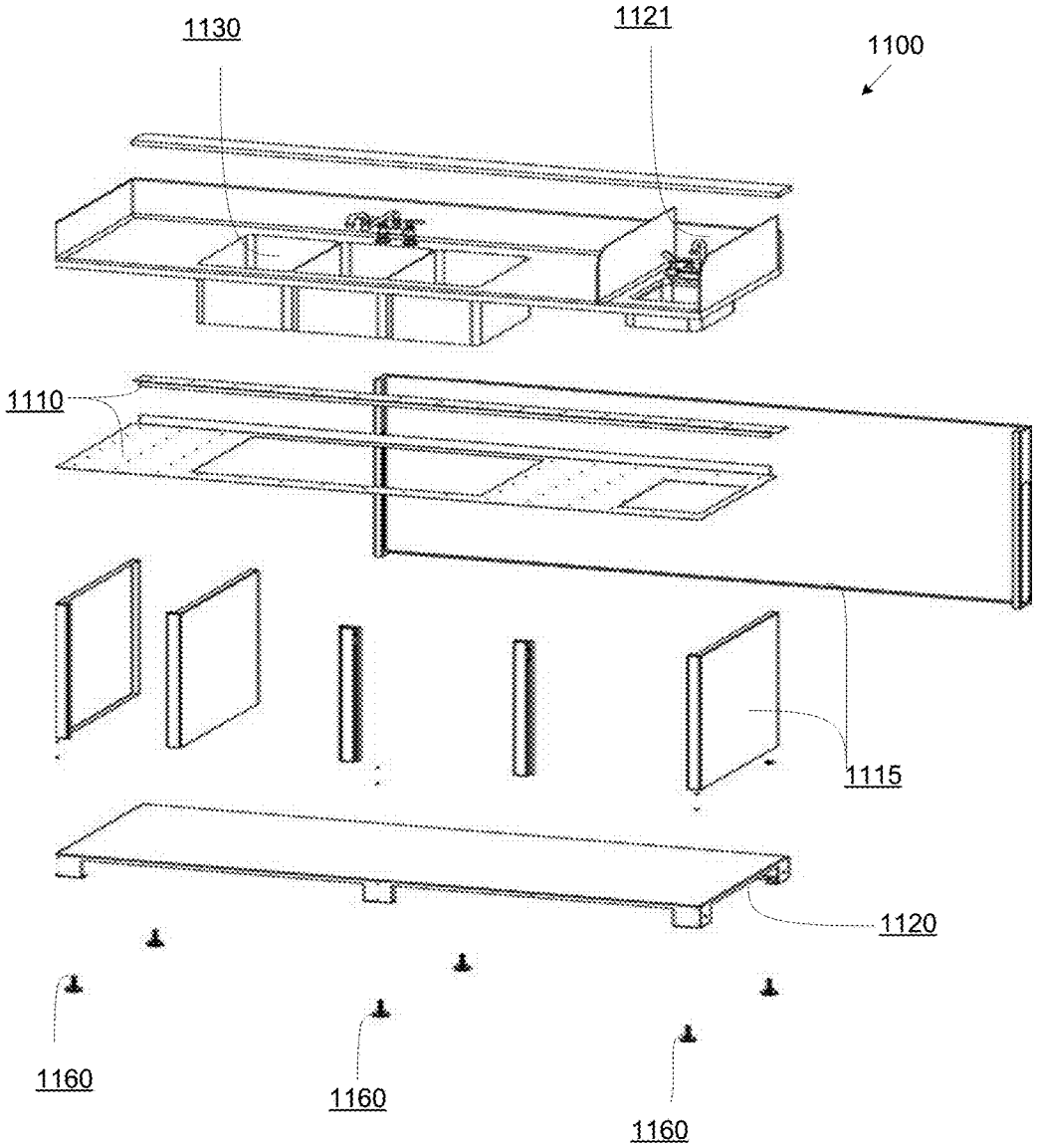
FIG. 12 shows an exploded view of the exemplary modular store unit shown in FIG. 11, according to one embodiment of the present disclosure.

FIG. 12 shows an exploded view of the exemplary modular store unit shown in FIG. 11, according to one embodiment of the present disclosure. As shown in FIG. 12, unit 1100 includes a baseplate 1120, one or more chassis 1115, and a subdeck 1110. Each of these components are substantially similar to the baseplate, one or more chassis, and subdeck of unit 100 discussed above (although different sizes) and will not be discussed in detail here.

In the embodiment shown in FIG. 12, the unit 1100 includes one or more level glides 1160, which are bolted to the bottom surface of the baseplate 1120. In various embodiments, the one or more level glides 1160 level the unit 1100 substantially parallel to the floor and also level the unit 1100 to adjacent units in a modular store system (e.g., the modular store system 900 shown in FIG. 9).

In various embodiments, the three compartment sink 1130 and the hand sink 1121 are attached onto the surface of the subdeck 1110 using anchor clips (not shown) and shock absorbing adhesive. In various embodiments, the anchor clips are attached to the bottom surface of the countertop and sinks 1130 using adhesive and are bolted to the chassis 1115 through access holes in the subdeck 1110.

Figure 13:
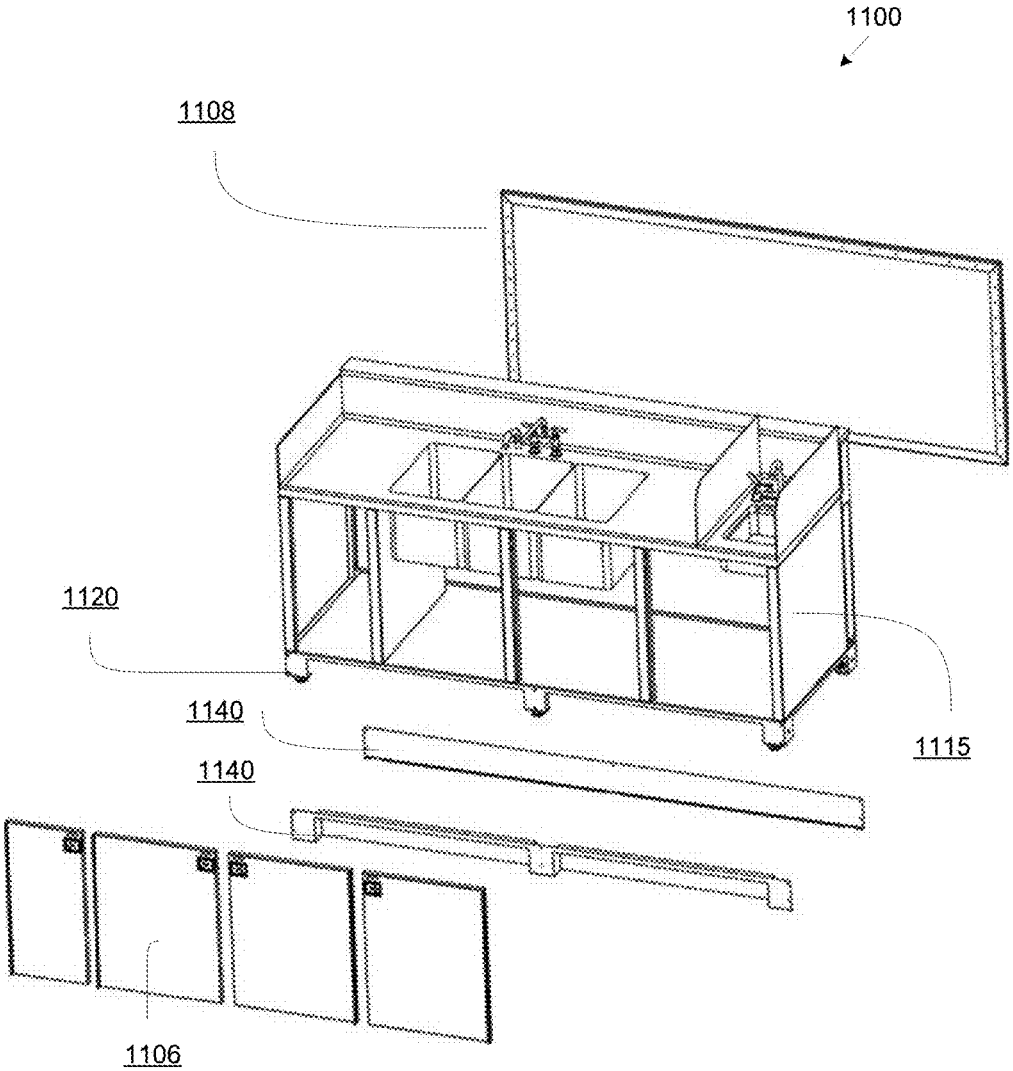
FIG. 13 shows a partially exploded view of the exemplary modular store unit shown in FIG. 11, according to one embodiment of the present disclosure.

FIG. 13 shows a partially exploded view of the exemplary modular store unit shown in FIG. 11, according to one embodiment of the present disclosure. In the embodiment shown in FIG. 13, the unit 1100 includes a veneer 1108 attached onto the one or more chassis 1115 utilizing a keyhole system (not shown) that allows the veneer 1108 to be attached or removed.

In various embodiments, the unit 1100 includes one or more kickplates 1140 attached onto the baseplate 1120 utilizing multiple screws to provide curbing to the unit as well as prevent debris from collecting underneath the unit. As will be understood from discussion herein, a kickplate may be connected to a baseplate by screws, bolts, locknuts, brackets, and/or welding.

The one or more kickplates 1140 may be sized and shaped to cover any gaps between the bottom of the baseplate 1120 and the floor. In various embodiments, the one or more kickplates 1140 are substantially the same length as a length of the overall unit 1100. In at least one embodiment, the one or more kickplates 1140 are made of a metal material and include one or more indentations (e.g., such that a user's foot may have room to fit at least partially under the unit 1100). As will be understood from discussions herein, the one or more kickplates 1140 may be made from any suitable material and, in at least one embodiment, are formed from metal (e.g., via a press or other suitable metal-forming mechanism).

In various embodiments, the unit 1100 includes one or more doors 1106. In particular embodiments, the doors 1106 are attached to one or more of the one or more chassis 1115 with hinges (e.g., piano hinges or other suitable hinges).

Figure 14A:
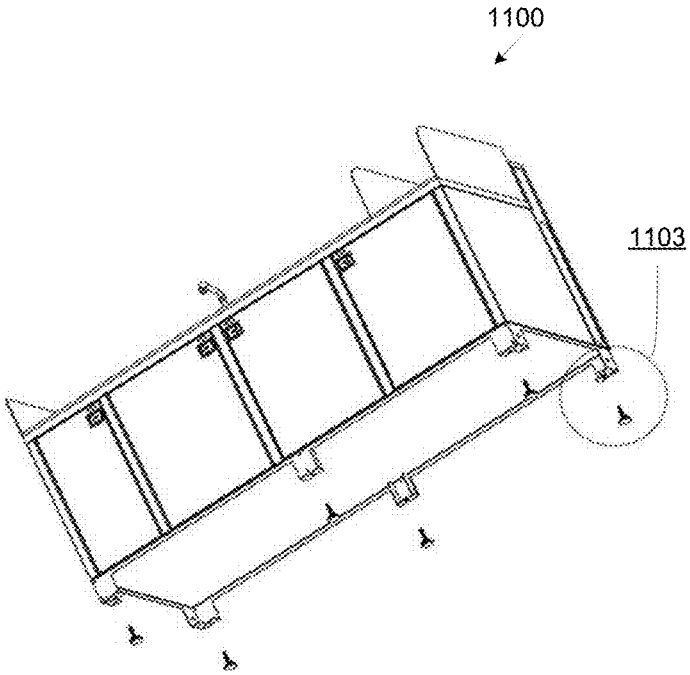
FIG. 14 (including FIGS. 14A-14B) shows a partially exploded view of the exemplary modular store unit shown in FIG. 11, according to one embodiment of the present disclosure.
Figure 14B:
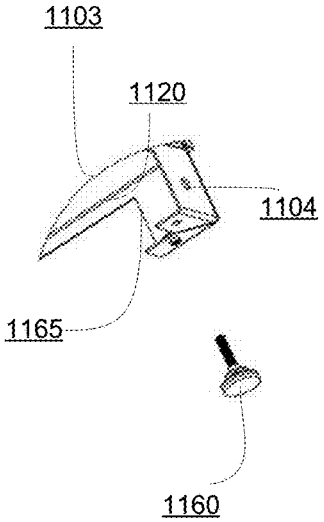

FIG. 14 (including FIGS. 14A-14B) shows a partially exploded view of the exemplary modular store unit shown in FIG. 11, according to one embodiment of the present disclosure. FIGS. 14A-14B show details of an exemplary connection point of level glides in view 1103. In the embodiment shown in FIG. 14, the unit 1100 includes one or more level glides 1160 that are attached to the legs 1165 of the baseplate 1120. In various embodiments, the legs 1165 of the baseplate 1120 include one or more nuts 1104 that are permanently attached to the legs 1165 of the baseplate 1120.

In one embodiment, the one or more level glides 1160 include a threaded shaft are attached to the bottom surface of the baseplate by the respective nuts 1104. As will be appreciated by one having ordinary skill in the art, rotating the threaded level glides raises or lowers (depending on the rotating direction) the unit 1100. Further, units of a modular store system can be leveled to the floor or adjacent units by this method of rotating to raise or lower the unit.

Figure 15A:
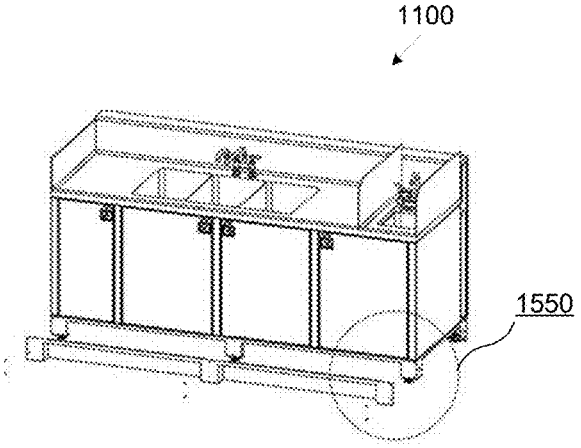
FIG. 15 (including FIGS. 15A-15B) shows a partially exploded view of the exemplary modular store unit shown in FIG. 11, according to one embodiment of the present disclosure.
Figure 15B:
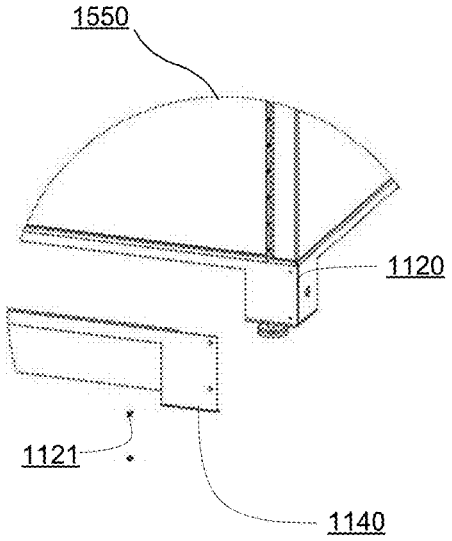

FIG. 15 (including FIGS. 15A-15B) shows a partially exploded view of the exemplary modular store unit shown in FIG. 11, according to one embodiment of the present disclosure. FIGS. 15A-15B show details of an exemplary connection point of one or more kickplates 1140 in view 1150. As shown in the embodiment of FIG. 15, the one or more kickplates 1140 are attached to the baseplate 1120 via one or more bolts or screws (e.g., the baseplate 1120 forms one or more holes in which a fastener can pass). In various embodiments, the one or more kickplates 1140 are attached to the vertical surface of the baseplate by multiple screws 1121. As will be appreciated by one of ordinary skill in the art, this attaching method may allow the one or more kickplates 1140 to be removed, re-attached and provides access to the underside of the unit if needed. It will also be understood that the one or more kickplates 1140 may be attached to the baseplate 1120 in any suitable way, including, but not limited to, by welding, an adhesive, etc.

As will be understood from discussions herein, the one or more kickplates 1140 are used to cover the baseplate 1120 and prevent debris from gathering underneath the unit 1100 and used as curbing for the modular store system. In various embodiments, the kickplates 1140 include "toe boxes" that act as relief for the operator or may be flat if located on the exterior side of the unit.

Figure 16A:
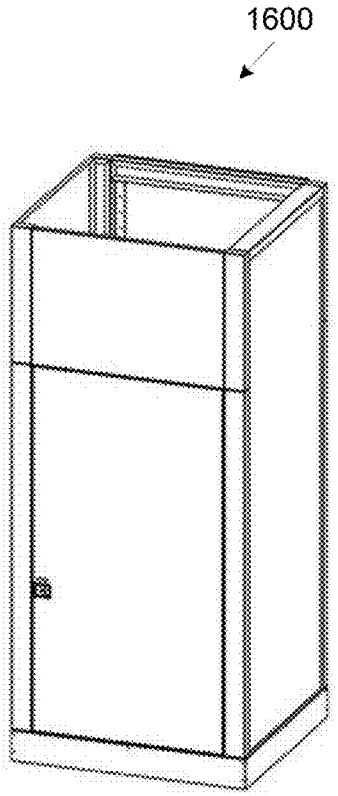
FIG. 16 (including FIGS. 16A-16B) shows a perspective view of an exemplary modular store unit, according to one embodiment of the present disclosure.
Figure 16B:
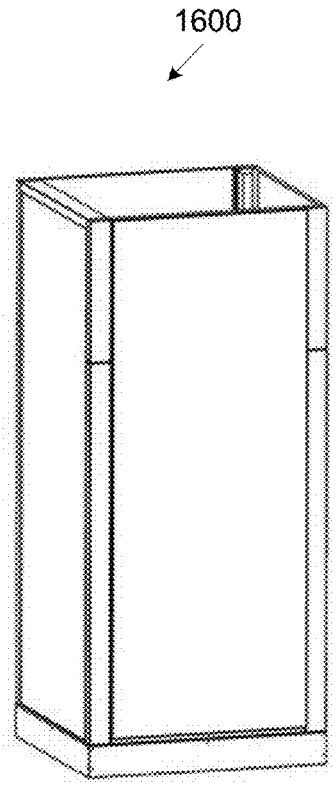

FIG. 16 (including FIGS. 16A-16B) shows a perspective view of an exemplary modular store unit, according to one embodiment of the present disclosure. FIG. 16 shows a tower unit design unit 1600, which may be used to house equipment like an ice maker and water filtration equipment. As would be understood from discussion herein, the tower unit 1600 maybe include, but not be limited to, various material including wood, plywood, steel, tile, stone, stainless steel, brick and polyvinyl.

Figure 17:
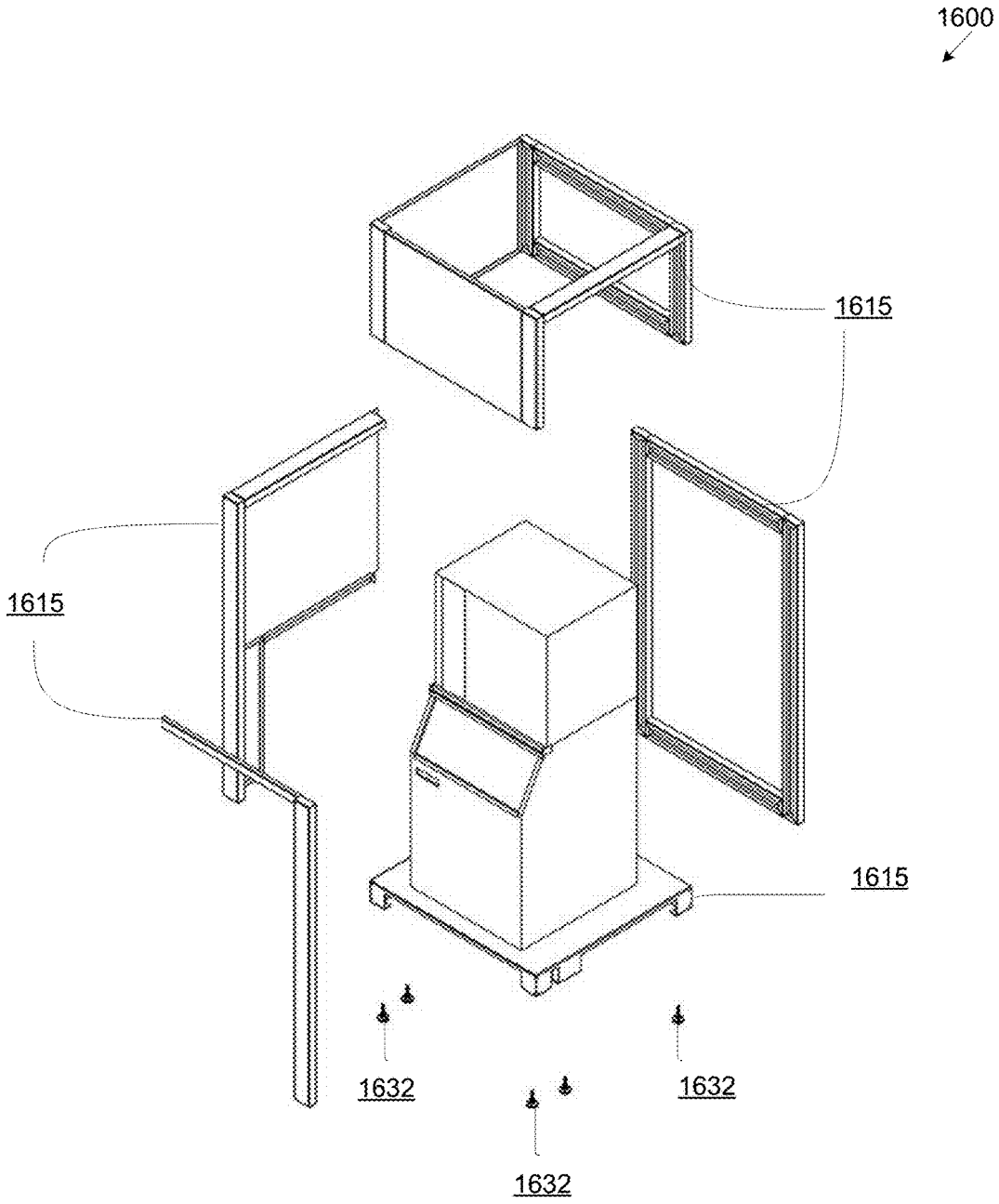
FIG. 17 shows a partially exploded view of the exemplary modular store unit shown in FIG. 16, according to one embodiment of the present disclosure.

FIG. 17 shows a partially exploded view of the exemplary modular store unit shown in FIG. 16, according to one embodiment of the present disclosure. In the embodiment shown in FIG. 17, the tower unit 1600 includes one or more chassis 1615 of an alternate size and shape than as previously described (but still for providing structural support to the unit 1600). The unit 1600, in the embodiment shown in FIG. 17, includes more than four (4) feet 1630 (with level glides 1632) formed from the baseplate 1615. As will be understood from discussions herein, a baseplate may include any suitable number of legs (e.g., based on the particular load a particular baseplate is designed to support).

Figure 18:
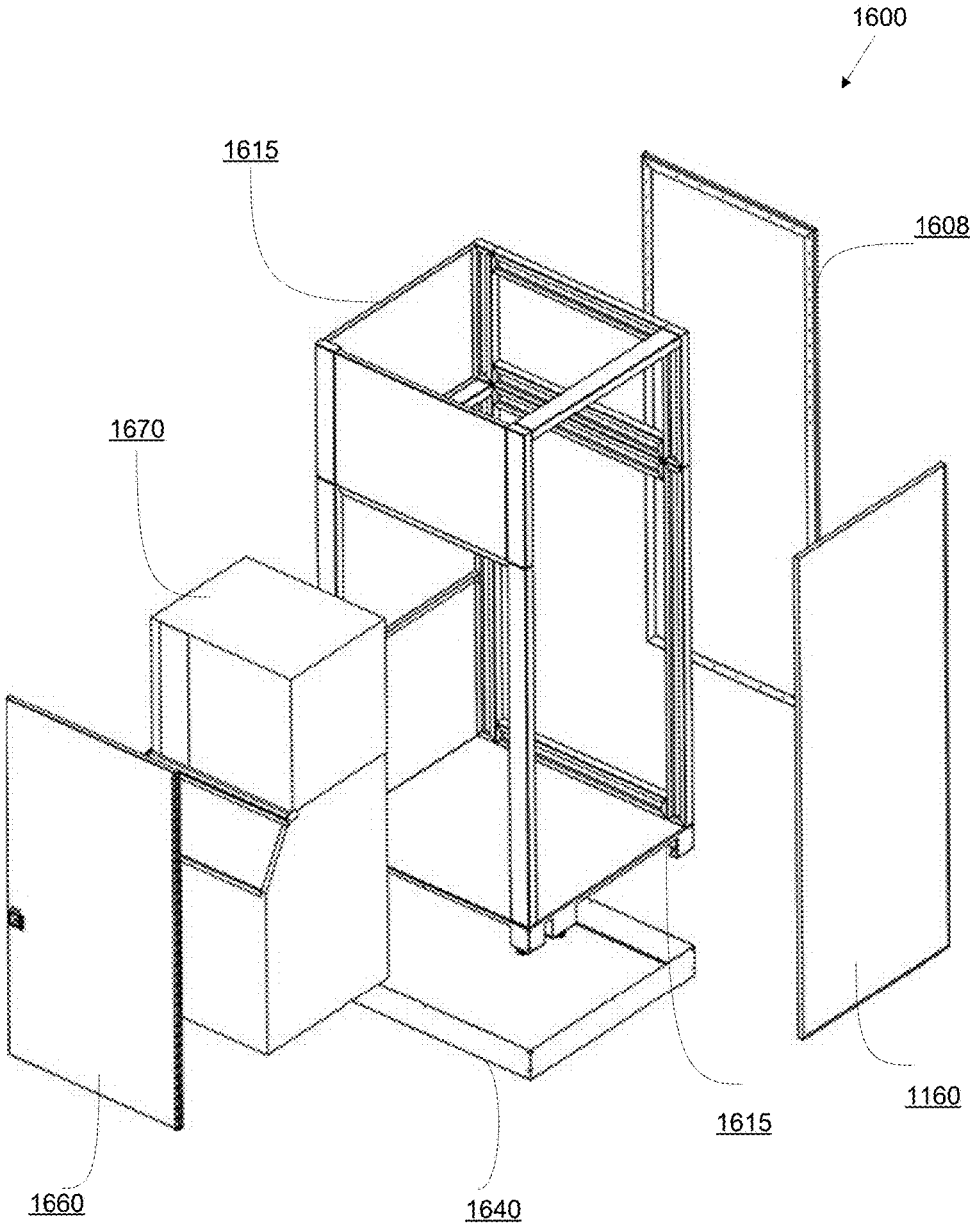
FIG. 18 shows a partially exploded view of the exemplary modular store unit shown in FIG. 16, according to one embodiment of the present disclosure.

FIG. 18 shows a partially exploded view of the exemplary modular store unit shown in FIG. 16, according to one embodiment of the present disclosure. In the embodiment shown in FIG. 18, the unit 1600 includes an ice maker 1670 bolted to the top surface of the baseplate 1615 inside the unit. In various embodiments, a veneer 1608 affixed onto the one or more chassis 1615 utilizing a keyhole system that allows the veneer 1608 to be attached or removed. In accordance with this disclosure, the unit 1600 may also include kickplates 1640 and/or a door 1660.

Additional Exemplary Modular Store Configurations

Figure 19:
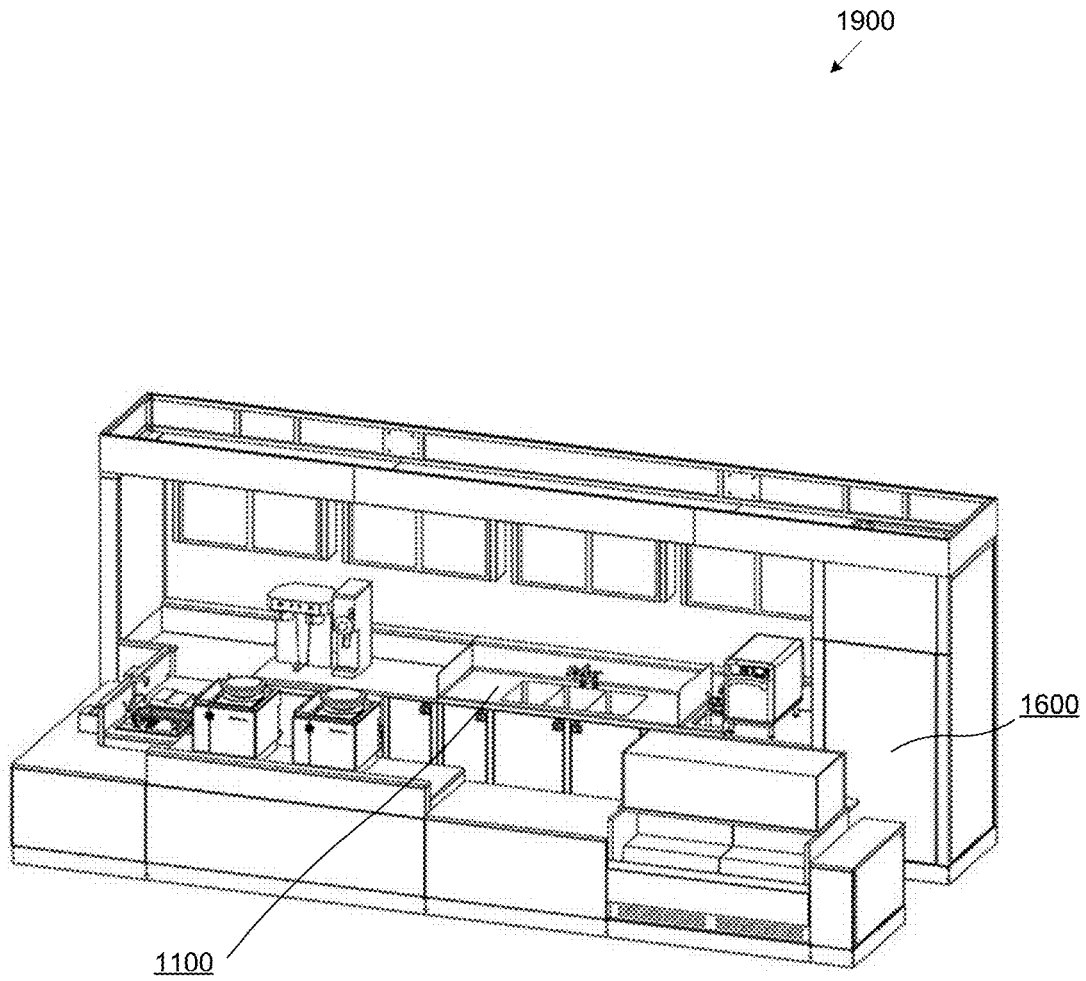
FIG. 19 shows a perspective view of exemplary modular store units included in an exemplary modular store.

FIG. 19 shows a perspective view of exemplary modular store units included in an exemplary modular store that may replace typical casework. As will be understood from discussions herein, exemplary modular store 1900 may be a kiosk type store. In various embodiments, each unit of the exemplary modular store 1900 is bolted onto the adjacent unit via each unit's baseplate (and/or one or more chassis). In various embodiments, a minimum of two bolts is used on the baseplates and two bolts on the chassis. As shown, the exemplary modular store 1900 includes exemplary unit 1100 and exemplary unit 1600, each described above.

Figure 20:
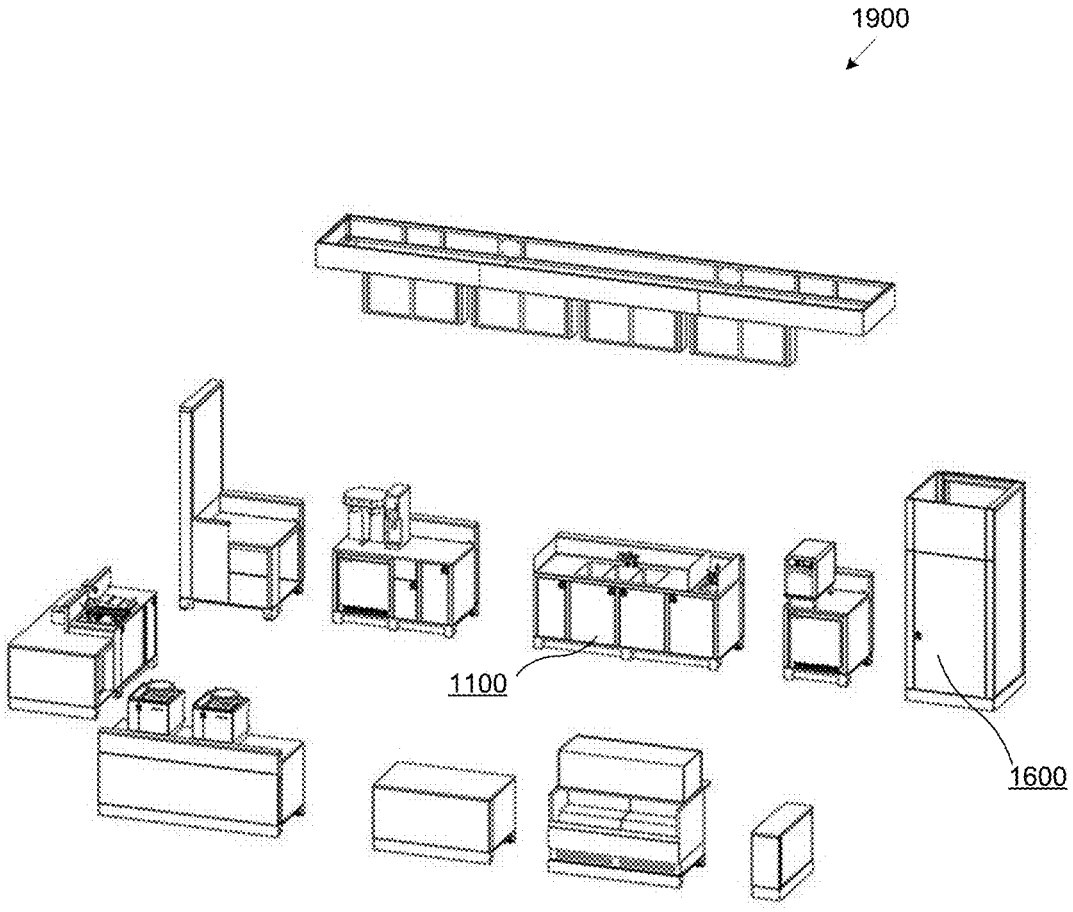
FIG. 20 shows an exploded view of the modular store system of FIG. 19, according to one embodiment of the present disclosure.

FIG. 20 shows an exploded view of the modular store system of FIG. 19 depicting each unit individually prior to being attached to its adjacent unit to form an exemplary modular store system. As shown, the modular store system 1900 includes a variety of different types of interconnected units, including unit 1100 and unit 1600 along with other types of exemplary units.

Figure 21:
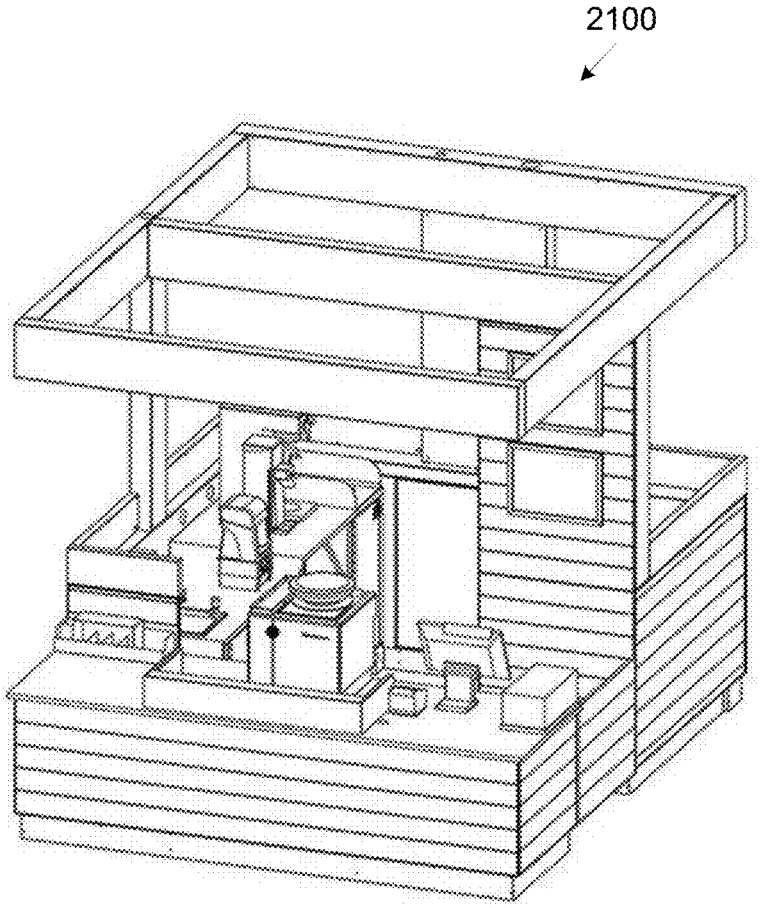
FIG. 21 shows a perspective view of exemplary modular store units.

FIG. 21 shows a perspective view of exemplary modular store units included in an exemplary modular store that may replace typical casework. As will be understood from discussions herein, exemplary modular store 2100 may be a kiosk type store. In various embodiments, each unit of the exemplary modular store 2100 is bolted onto the adjacent unit via each unit's baseplate (and/or one or more chassis). In some embodiments, a minimum of two bolts is used on the baseplates and two bolts on the chassis as shown in FIG. 2. As shown, the exemplary modular store 2100 may include one or more units that are substantially similar to units 100 and 1100 described above.

Figure 22:
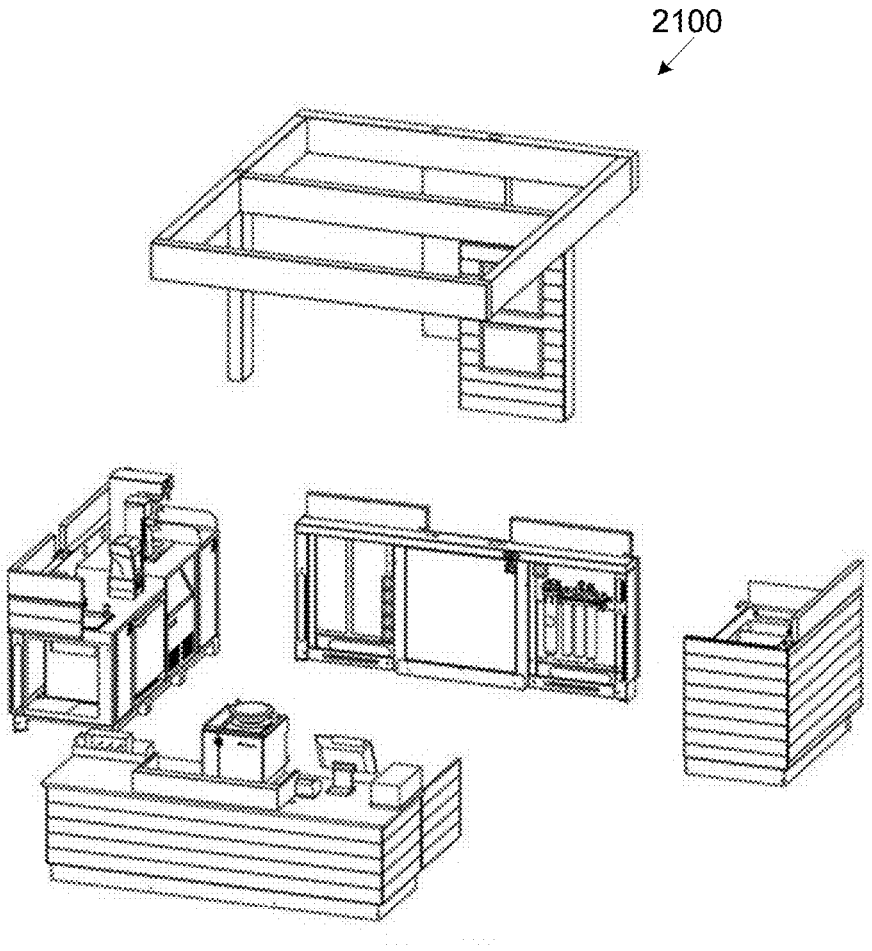
FIG. 22 shows an exploded view of the modular store system of FIG. 21, according to one embodiment of the present disclosure.

FIG. 22 shows an exploded view of the modular store system of FIG. 21. As shown, the modular store system 2100 includes a variety of different types of interconnected units, which, in various embodiments, each include a baseplate, subdeck, and one or more chassis as substantially described above.

Figure 23:
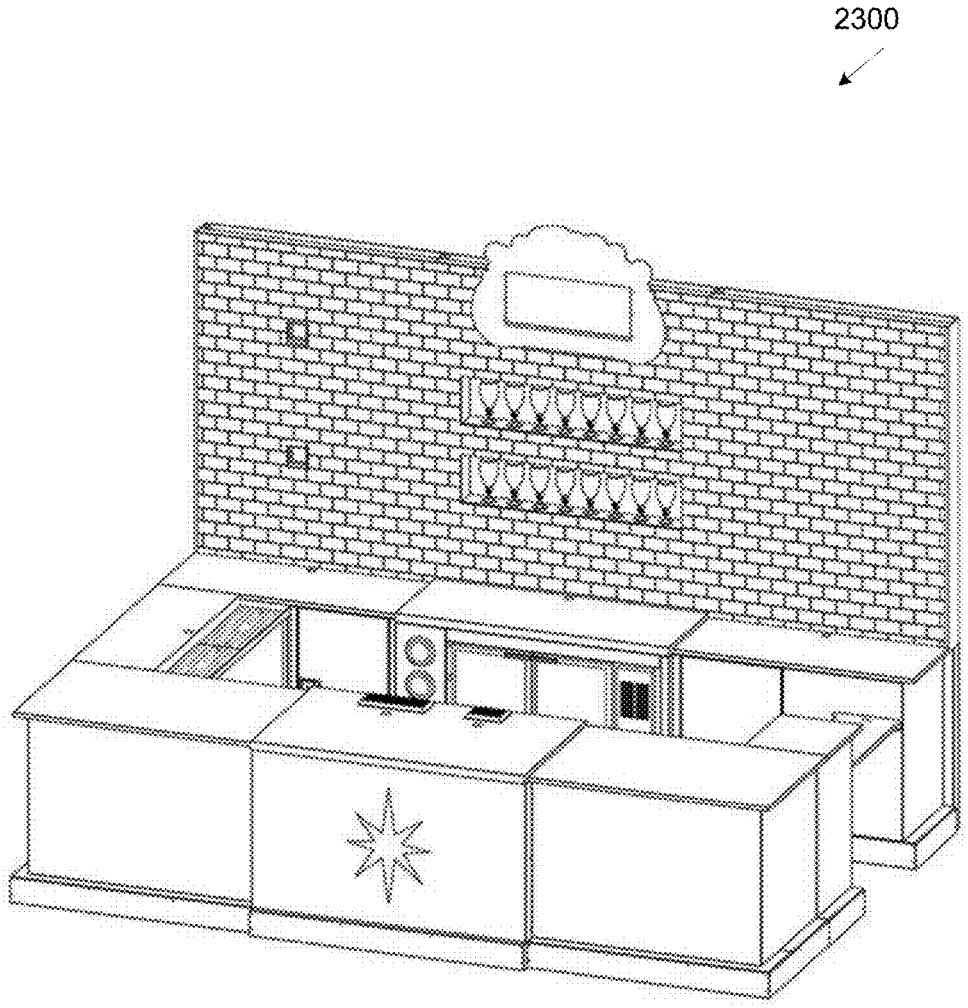
FIG. 23 shows a perspective view of exemplary modular store units.

FIG. 23 shows a perspective view of exemplary modular store units included in an exemplary modular store that may replace typical casework. As will be understood from discussions herein, exemplary modular store 2300 may be a kiosk type store. In various embodiments, each unit of the exemplary modular store 2300 is bolted onto the adjacent unit via each unit's baseplate (and/or one or more chassis). In particular embodiments, a minimum of two bolts is used on the baseplates and two bolts on the chassis. As shown, the exemplary modular store 2300 includes an assortment of different types of interconnected units.

Figure 24:
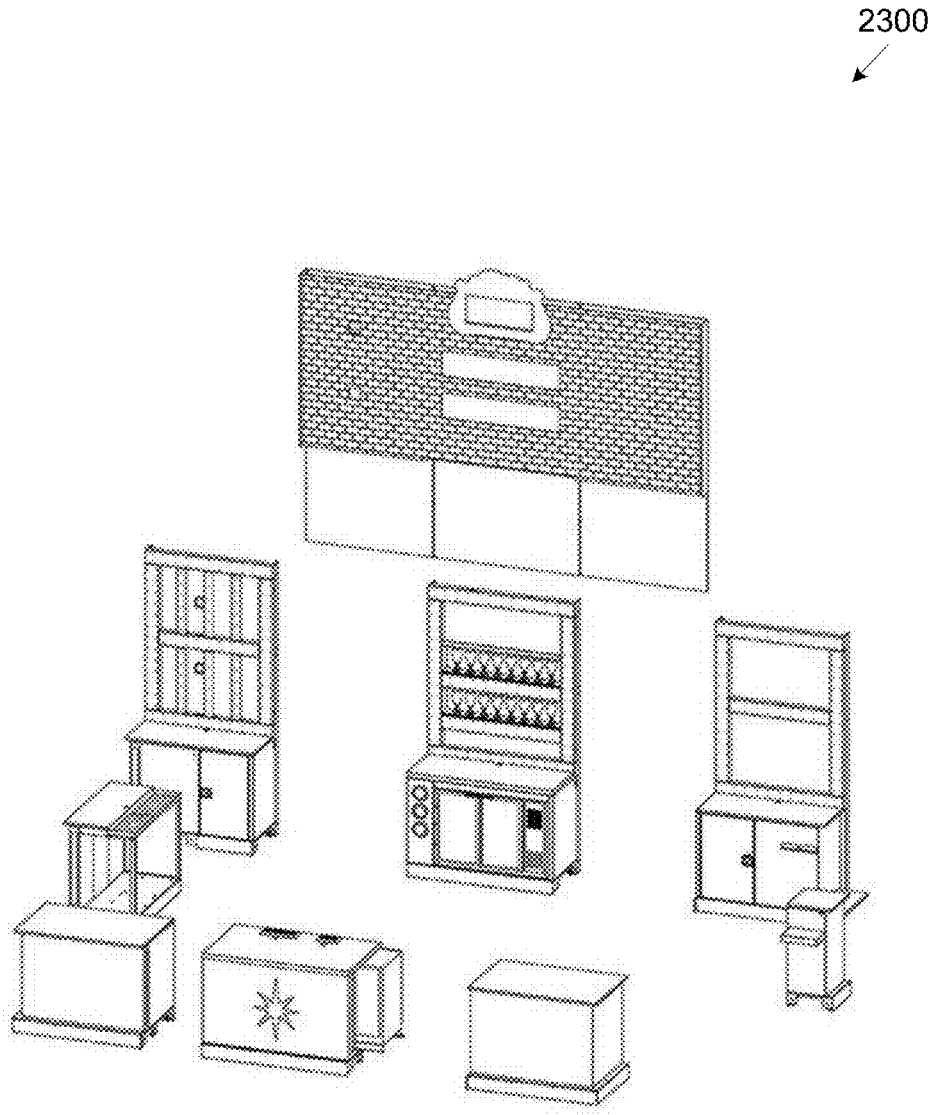
FIG. 24 shows an exploded view of the modular store system of FIG. 23, according to one embodiment of the present disclosure.

FIG. 24 shows an exploded view of the modular store system of FIG. 23. As shown, the modular store system 2300 includes a variety of different types of interconnected units.

Figure 25:
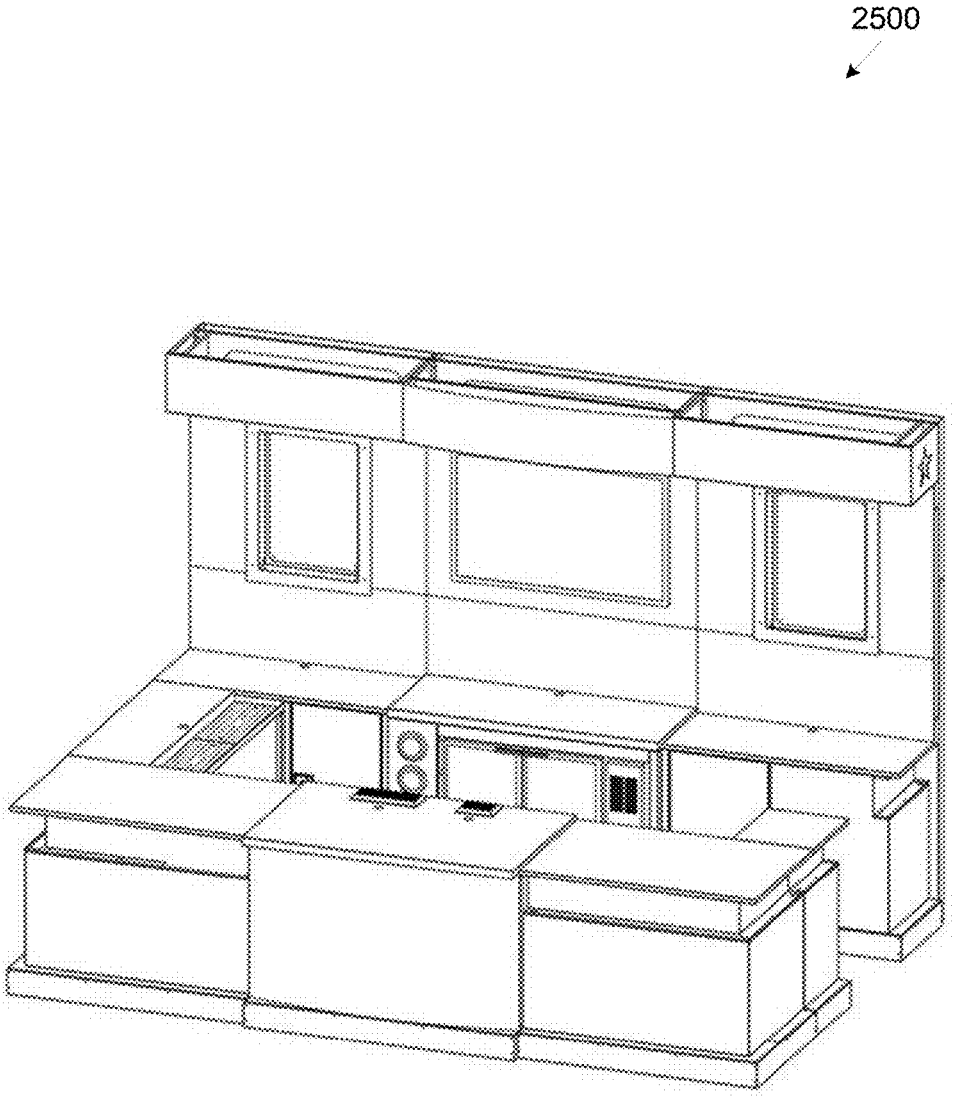
FIG. 25 shows a perspective view of exemplary modular store units.

FIG. 25 shows a perspective view of exemplary modular store units included in an exemplary modular store that may replace typical casework. As will be understood from discussions herein, exemplary modular store 2500 may be a kiosk type store. In various embodiments, each unit of the exemplary modular store 2500 is bolted onto the adjacent unit via each unit's baseplate (and/or one or more chassis). In some embodiments, a minimum of two bolts is used on the baseplates and two bolts on the chassis. As shown, the exemplary modular store 2500 includes an assortment of different types of interconnected units.

Figure 26:
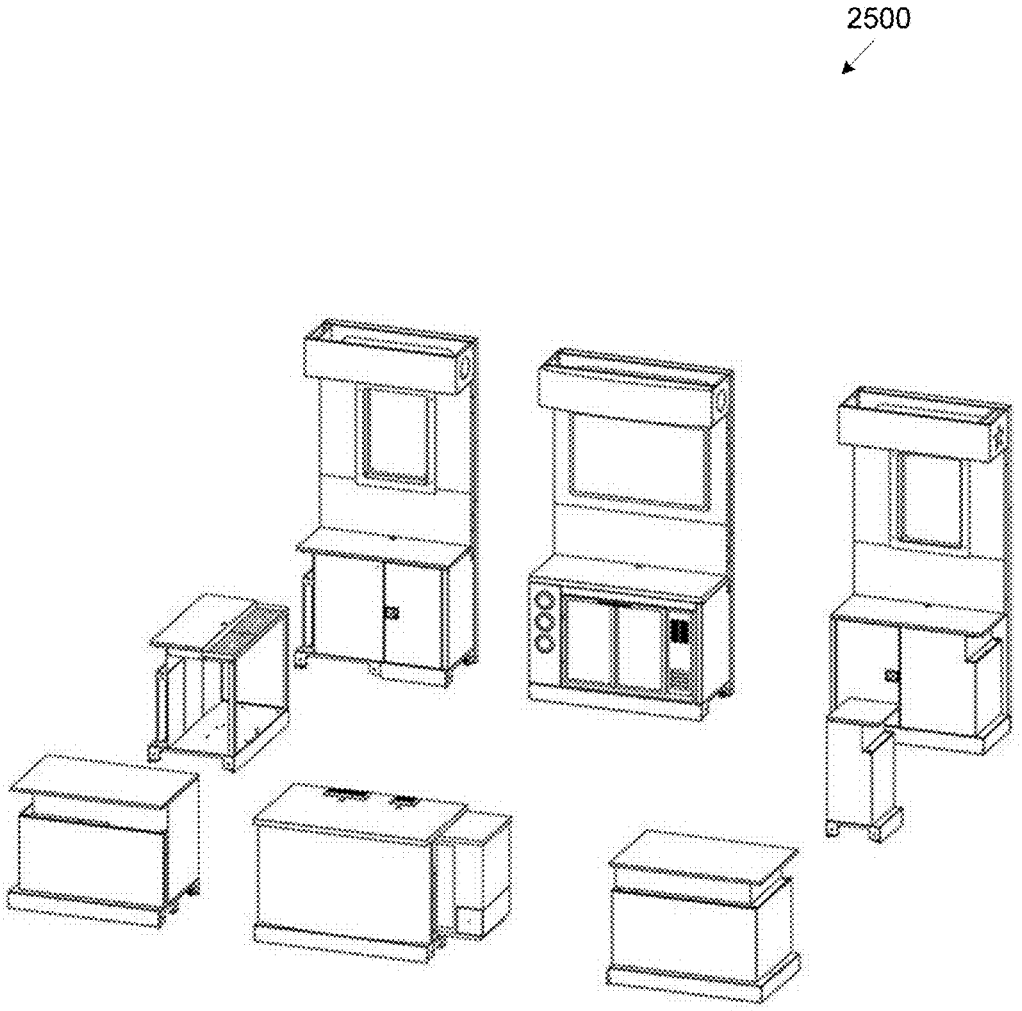
FIG. 26 shows an exploded view of the modular store system of FIG. 25.

FIG. 26 shows an exploded view of the modular store system of FIG. 25. As shown, the modular store system 2500 includes a variety of different types of interconnected units.

Figure 27A:
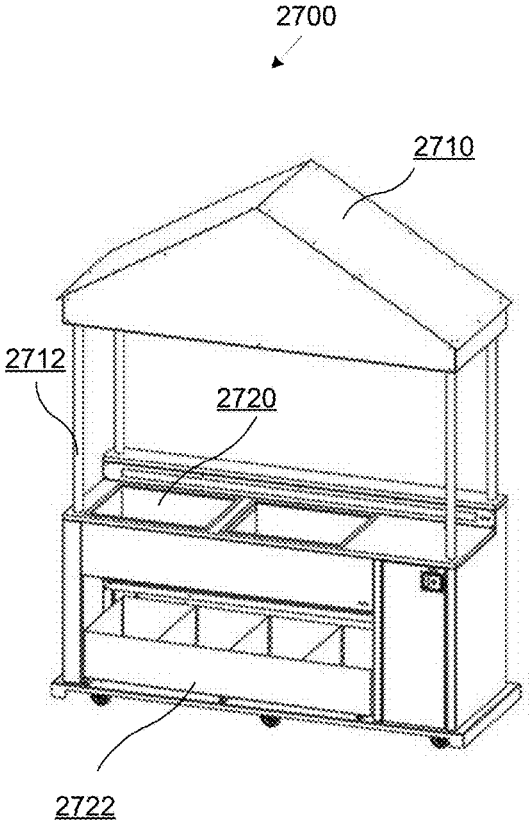
FIG. 27 (including FIGS. 27A-27B) shows a perspective view of exemplary modular store units.
Figure 27B:
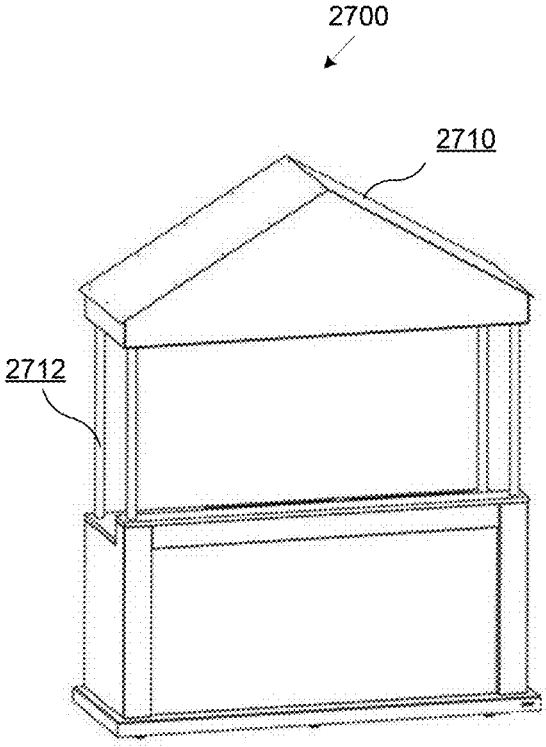

FIG. 27 (including FIGS. 27A-27B) illustrates a perspective view of an exemplary modular store unit included in an exemplary modular store that may replace typical casework. As will be understood from discussions herein, exemplary modular store 2700 may be a cart type store. In various embodiments, each unit of the exemplary modular store 2700 is bolted onto the adjacent unit via each unit's baseplate (and/or one or more chassis). In particular embodiments, a minimum of two bolts is used on the baseplates and two bolts on the chassis as shown in FIG. 2. As shown, the exemplary modular store 2700 includes an assortment of different types of equipment.

In various embodiments, the unit may include a canopy 2710, which is generally triangular in shape and includes one or more vertical legs 2712. As would be understood from discussion herein, the canopy may include wood, plywood, stone, tile, upholstery, steel, stainless steel, metal, glass, brick etc. In particular embodiments, the modular store 2700 may include, among other things, a hollowed compartment 2720 suitable for storage and a shelf system 2722.

Figure 28A:
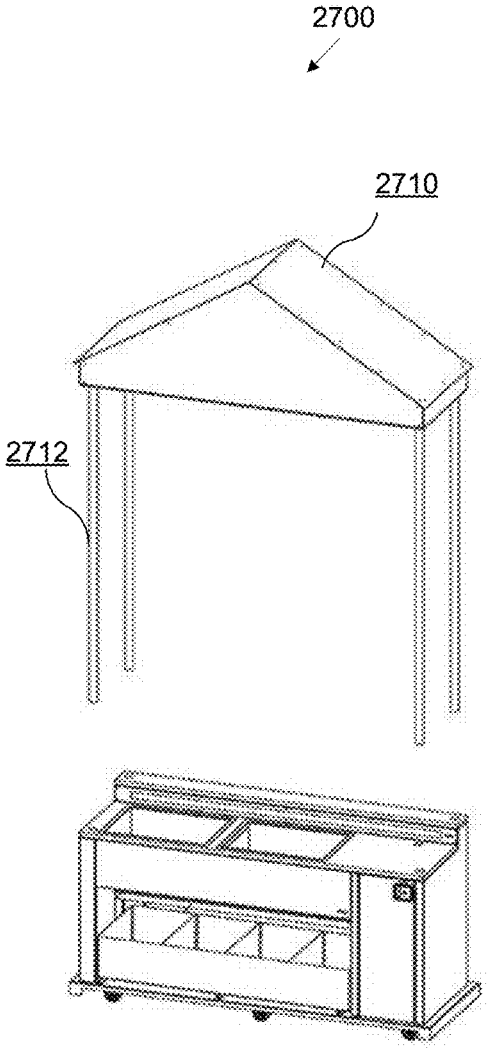
FIG. 28 (including FIGS. 28A-28B) shows an exploded view of the modular store system of FIG. 27, according to one embodiment of the present disclosure.
Figure 28B:
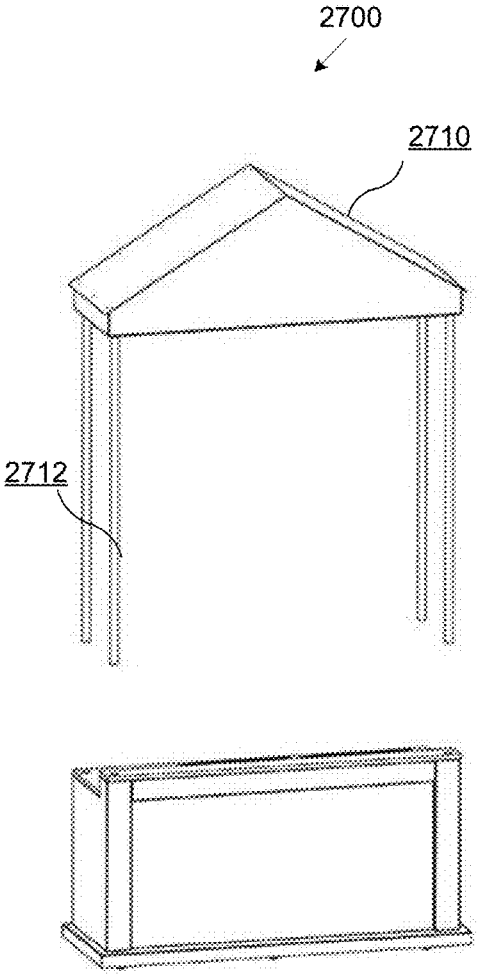

FIG. 28 (including FIGS. 28A-28B) shows an exploded view of the modular store system of FIG. 27. As shown, the modular store system 2700 includes The canopy 2710 is attached to the one or more vertical legs 2712 and the canopy 2710 and one or more vertical legs 2712 may be detached from the modular store 2700 (e.g., are detachably coupled to the modular store 2700).

Figure 29A:
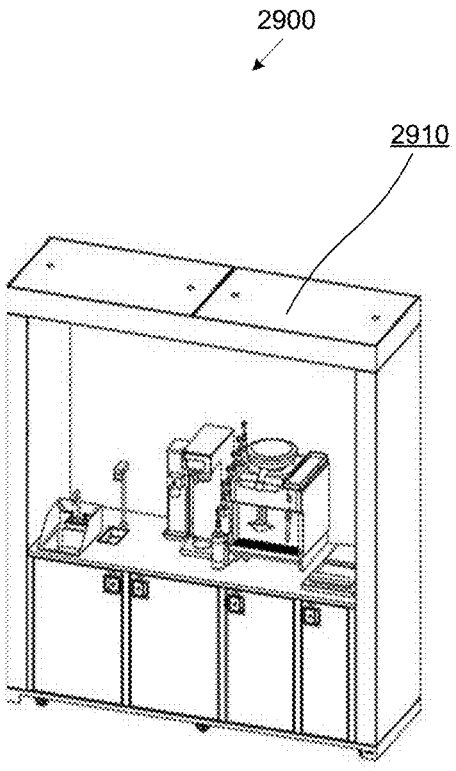
FIG. 29 (including FIGS. 29A-29B) shows a perspective view of exemplary modular store units.
Figure 29B:
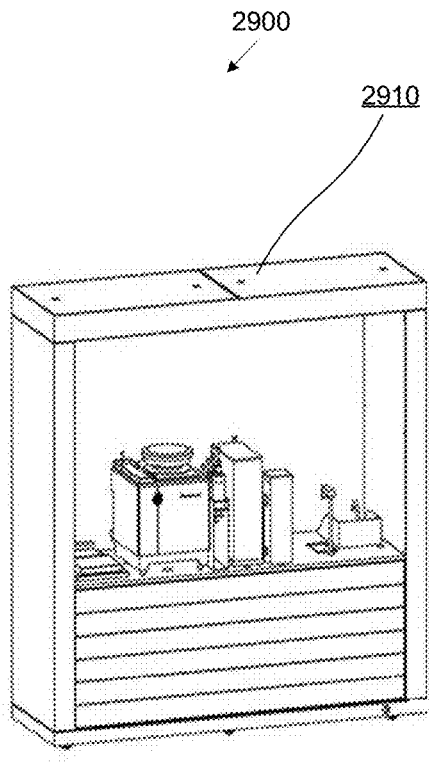

FIG. 29 (including FIGS. 29A-29B) illustrates a perspective view of an exemplary modular store unit included in an exemplary modular store that may replace typical casework. As will be understood from discussions herein, exemplary modular store 2900 may be a cart type store. In various embodiments, each unit of the exemplary modular store 2900 is bolted onto the adjacent unit via each unit's baseplate 2920 (and/or one or more chassis). In various embodiments, a minimum of two bolts is used on the baseplates 2920 and two bolts on the chassis as shown in FIG. 2. As shown, the exemplary modular store 2900 may include a variety of units (single units or interconnected units) and any suitable equipment.

In various embodiments, the exemplary modular store 2900 may include a canopy 2910 that is generally rectangular in shape. In some embodiments, the canopy 2910 maybe between 48 inches wide by 144 inches long, 36 inches wide by 60 inches long, 24 inches wide by 36 inches long, etc. As would be understood from discussion herein, the canopy may consist of wood, plywood, stone, tile, upholstery, steel, stainless steel, metal, glass, brick etc.

Figure 30:
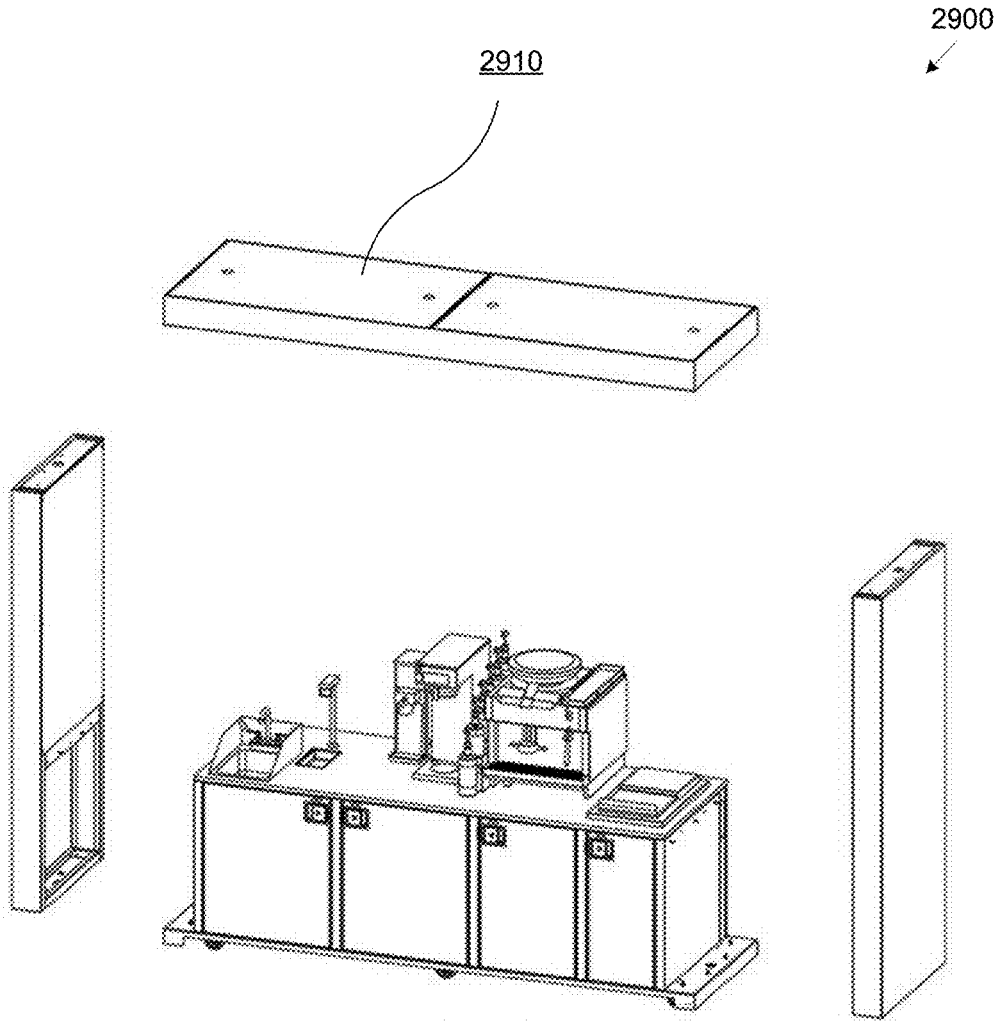
FIG. 30 shows a partially exploded view of the modular store system of FIG. 29, according to one embodiment of the present disclosure.

FIG. 30 shows an exploded view of the modular store system of FIG. 29. As shown, the modular store system 2900 includes the canopy 2910, which may include wall supports that may be connected or detached.

Figures 31A, 31B:
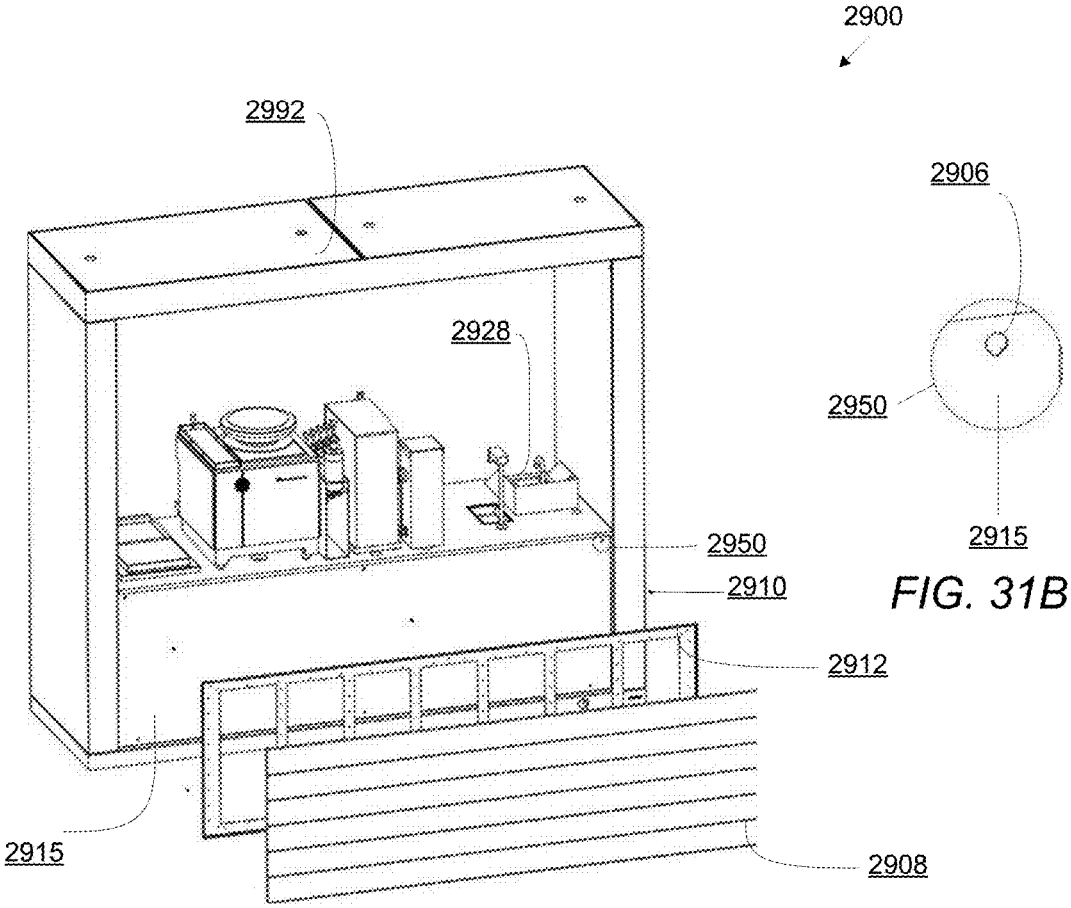
FIG. 31 (including FIGS. 31A-31B) shows a partially exploded view of the modular store system of FIG. 29, according to one embodiment of the present disclosure.

FIG. 31 (including FIGS. 31A-31B) shows a partially exploded view of the modular store system of FIG. 29. FIGS. 31A-31B show details of an exemplary connection point of keyhole 2906 in view 2950. As shown, the exemplary modular store 2900 includes a hand sink 2928 and assortment of different types of equipment.

In various embodiments, a veneer 2908 is connected to a veneer frame 2912 that provides structural support to the veneer 2908.

In at least one embodiment, the veneer 2908 with the veneer frame 2912 are attached to the one or more chassis 2915 utilizing a keyhole 2906 that allows the veneer 2908 to be attached to the keyhole 2906 via the keyhole fastener 2910 or removed for refurbishment and upgrades. In one or more embodiments, the keyhole 2906 is formed by the one or more chassis 2915 and includes a first circular portion and a second, smaller circular portion near the bottom of the first circular portion. As will be understood, a stud (e.g., keyhole fastener 2910) may be inserted through the first circular portion and then become lodged within the second, smaller circular portion via the weight of the veneer 2908. As such, in particular embodiments, the veneer 2908 may be removed by lifting the veneer 2908 such that any connected studs are aligned with the first circular portion of the keyhole 2906 and can thus be removed from the one or more chassis 2915.

CONCLUSION

While various aspects have been described in the context of a particular embodiments, additional aspects, features, and methodologies of the claimed systems and methods will be readily discernible from the description herein, by those of ordinary skill in the art. Many embodiments and adaptations of the disclosure and claimed systems and methods other than those herein described, as well as many variations, modifications, and equivalent arrangements and methodologies, will be apparent from or reasonably suggested by the disclosure and the foregoing description thereof, without departing from the substance or scope of the claims. Furthermore, any sequence(s) and/or temporal order of steps of various processes described and claimed herein are those considered to be the best mode contemplated for carrying out the claimed systems and methods. It should also be understood that, although steps of various processes may be shown and described as being in a preferred sequence or temporal order, the steps of any such processes are not limited to being carried out in any particular sequence or order, absent a specific indication of such to achieve a particular intended result. In most cases, the steps of such processes may be carried out in a variety of different sequences and orders, while still falling within the scope of the claimed systems and methods. In addition, some steps may be carried out simultaneously, contemporaneously, or in synchronization with other steps.

The embodiments were chosen and described in order to explain the principles of the claimed systems and methods and their practical application so as to enable others skilled in the art to utilize the inventions and various embodiments and with various modifications as are suited to the particular use contemplated. Alternative embodiments will become apparent to those skilled in the art to which the claimed systems and methods pertain without departing from their spirit and scope. Accordingly, the scope of the claimed systems and methods are defined by the appended claims rather than the foregoing description and the exemplary embodiments described therein.

What is claimed is:

1. A modular store system comprising:

a modular unit comprising:

a substantially rectangular metal baseplate comprising one or more legs, wherein the one or more legs are formed by bending a portion of the baseplate;

one or more intermediate chassis connected to the baseplate, wherein each of the one or more intermediate chassis are substantially perpendicular to the baseplate, made of a metal material, and comprise: a) at least one approximate 90 degree bend forming a first support arm substantially perpendicular to the baseplate; b) at least one approximate 90 degree bend forming a second support arm substantially parallel and connected to the baseplate; and c) at least one fastener hole;

a back chassis comprising at least one 90 degree bend forming a back support arm and defining a substantially keyhole-shaped opening, wherein the back chassis is connected to: a) at least one of the one or more intermediate chassis via the back support arm; b) a subdeck; and c) a veneer;

the subdeck comprising one or more access holes and one or more studs, wherein the subdeck is connected to the one or more intermediate chassis via the one or more studs;

a countertop comprising at least one anchor, the anchor fixed to the countertop via an adhesive and connected to the one or more intermediate chassis through one of the one or more access holes in the subdeck;

a shock-absorbing adhesive between the subdeck and the countertop; and a veneer detachably connected to the back chassis via the keyhole-shaped opening.

2. The modular store system of claim 1, wherein the modular unit comprises one or more level glides or one or more casters connected to the baseplate.

3. The modular store system of claim 1, wherein the modular unit is a first modular unit connected to one or more second modular units.

4. The modular store system of claim 3, wherein the back support arm defines an elongated oval utility cutout and the modular store system comprises one or more preinstalled utility lines that pass through the elongated oval utility cutout.

5. The modular store system of claim 4, wherein the one or more preinstalled utility lines pass through the elongated oval utility cutout of the first modular unit and a utility cutout of one of the one or more second modular units.

6. The modular store system of claim 5, wherein at least one of the first modular unit and the second one or more modular units comprises a kickplate connected to the baseplate.

7. The modular store system of claim 6, wherein each of the first modular unit and the second one or more modular units comprises a kickplate connected to the baseplate.

8. A modular store system comprising:

a modular unit comprising:

a substantially rectangular metal baseplate comprising one or more legs, wherein the one or more legs are formed by bending a portion of the baseplate;

one or more intermediate chassis connected to the baseplate, wherein each of the one or more intermediate chassis are made of a metal material and: a) comprise at least one approximate 90 degree bend forming a support arm; b) comprise at least one fastener hole; and c) are substantially perpendicular to the baseplate;

a back chassis comprising at least one 90 degree bend forming a back support arm, wherein the back chassis is connected to each of the one or more intermediate chassis and a subdeck;

the subdeck comprising one or more access holes and one or more studs, wherein the subdeck is connected to the one or more intermediate chassis via the one or more studs; and a countertop comprising at least one anchor, the anchor fixed to the countertop via an adhesive and connected to the one or more intermediate chassis through one of the one or more access holes in the subdeck.

9. The modular store system of claim 8, wherein the back chassis is connected to at least one of the one or more intermediate chassis via the back support arm and the support arm, respectively.

10. The modular store system of claim 8, wherein:

the modular unit comprises a particular intermediate chassis, the particular intermediate chassis comprising a second support arm, the second support arm substantially parallel to the baseplate of the first modular unit; and the particular intermediate chassis is connected to the baseplate of the modular unit via the second support arm.

11. The modular store system of claim 10, wherein the modular unit comprises a veneer, the veneer detachably connected to the back chassis of the modular unit.

12. The modular store system of claim 11, wherein:

the back chassis defines a substantially keyhole-shaped opening; and the veneer is detachably connected to the back chassis via the keyhole-shaped opening.

13. The modular store system of claim 12, wherein the modular unit comprises shock-absorbing adhesive between the subdeck and the countertop.

14. The modular store system of claim 13, wherein the modular unit comprises one or more level glides or one or more casters connected to the baseplate.

15. The modular store system of claim 13, wherein the modular unit comprises at least one door operatively connected to at least one of the one or more intermediate chassis.

16. The modular store system of claim 13, wherein the modular unit is a first modular unit connected to one or more second modular units.

17. The modular store system of claim 16, wherein the back support arm defines an elongated oval utility cutout and the modular store system comprises one or more preinstalled utility lines that pass through the elongated oval utility cutout.

18. The modular store system of claim 17, wherein the one or more preinstalled utility lines pass through the elongated oval utility cutout of the first modular unit and a utility cutout of one of the one or more second modular units.

19. The modular store system of claim 18, wherein at least one of the first modular unit and the second one or more modular units comprises a kickplate connected to the baseplate.

20. The modular store system of claim 19, wherein each of the first modular unit and the second one or more modular units comprises a kickplate connected to the baseplate.

* * * * *